US007554049B2

(12) United States Patent
Wada et al.

(10) Patent No.: US 7,554,049 B2
(45) Date of Patent: Jun. 30, 2009

(54) ROCKING SWITCH UNIT

(75) Inventors: Hiromune Wada, Nagoya (JP); Koichi Masuda, Obu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/073,840

(22) Filed: Mar. 11, 2008

(65) Prior Publication Data

US 2008/0230360 A1 Sep. 25, 2008

(30) Foreign Application Priority Data

Mar. 20, 2007 (JP) ..... 2007-072760
Jan. 8, 2008 (JP) ..... 2008-001518

(51) Int. Cl.
*H01H 23/00* (2006.01)

(52) U.S. Cl. ..... 200/339; 200/553

(58) Field of Classification Search ..... 200/5 R, 200/5 A, 517, 553, 557, 558, 339
See application file for complete search history.

(56) References Cited

U.S. PATENT DOCUMENTS

| | | | | |
|---|---|---|---|---|
| 6,437,259 | B1 * | 8/2002 | Geppert et al. | 200/5 R |
| 6,559,398 | B2 * | 5/2003 | Takeda et al. | 200/339 |
| 6,617,535 | B2 * | 9/2003 | Lacroix | 200/339 |
| 6,756,553 | B1 | 6/2004 | Yamaguchi et al. | |
| 6,809,273 | B2 | 10/2004 | Ito et al. | |
| 6,914,201 | B2 * | 7/2005 | Van Vooren et al. | 200/1 B |
| 6,914,202 | B2 * | 7/2005 | Sugimoto et al. | 200/1 B |
| 7,084,359 | B1 * | 8/2006 | Konno | 200/1 B |
| 7,268,305 | B2 * | 9/2007 | Schmidt et al. | 200/5 R |

FOREIGN PATENT DOCUMENTS

| | | |
|---|---|---|
| JP | 60-073142 | 5/1985 |
| JP | 2-124627 | 10/1990 |
| JP | 10-125179 | 5/1998 |
| JP | 2001-014980 | 1/2001 |
| JP | 2004-039592 | 2/2004 |
| JP | 2004-146128 | 5/2004 |
| JP | 2005-019347 | 1/2005 |
| JP | 2005-310413 | 11/2005 |
| JP | 2006-040562 | 2/2006 |

OTHER PUBLICATIONS

Japanese Office Action dated Nov. 19, 2008 issued in counterpart Japanese Application No. 2008-001518, with English translation.

* cited by examiner

*Primary Examiner*—Michael A Friedhofer
(74) *Attorney, Agent, or Firm*—Nixon & Vanderhye PC

(57) ABSTRACT

A rocking switch unit includes a base section, a switch knob, a pair of tactile switches, a middle rocking section, and a pair of switch-pressing portions. The switch knob and the middle rocking section are coupled with the base section to be rockable. The switch-pressing portions are located between a pair of rocking end portions of the switch knob and the tactile switches, for transmitting a pressing force from one of the rocking end portions to a corresponding tactile switch when the one of the rocking end portions is pressed in a pressing direction. The switch-pressing portions are coupled with two end portions of the middle rocking section in such a manner that a coupling angle between a rocking surface of the middle rocking section and rocking surfaces of the switch-pressing portions is variable in a pressing direction.

15 Claims, 15 Drawing Sheets

ROCKING SWITCH UNIT

CROSS REFERENCE TO RELATED APPLICATION

This application is based on Japanese Patent Applications No. 2007-72760 filed on Mar. 20, 2007, and No. 2008-1518 filed on Jan. 8, 2008, the contents of which are incorporated herein by reference in their entirety.

BACKGROUND OF THE INVENTION

1. Field of the Invention

The present invention relates to a rocking switch unit.

2. Description of the Related Art

Conventionally, a vehicle such as an automobile has an operating device for operating an electronic apparatus including an air-conditioning system, an audio system, and a navigation system. The operating device includes an operating portion that is operated by a passenger. The operating portion has a seesaw switch configured as a rocking switch unit. In the seesaw switch, a rocking switch knob is attached to a rocking fulcrum to be rockable. When a pressing force is applied to one of longitudinal end portions of the rocking switch knob, a tactile switch that is disposed on a rear side of the one end portion in a pressing direction is pressed, while another tactile switch that is disposed on a rear side of the other end portion in the pressing direction is released. Thereby, conductive conditions of the two tactile switches are switched. The tactile switches are disposed in such a manner that switch surfaces are arranged approximately perpendicularly to the pressing direction of the rocking switch knob.

The seesaw switch is required that when the rocking switch knob is pressed by a user, the switch surface of tactile switch is pressed with a high degree of certainty and the user can receive an operation feeling (feeling of a click) from the pressed tactile switch. Thus, the switch surface of the tactile switch is required to be pressed vertically when one of longitudinal end portions of the rocking switch knob is pressed. In the seesaw switch, the rocking switch knob rotates on the rocking fulcrum. Thus, when a distance between the rocking fulcrum and the switch surfaces of the tactile switches increases, the rocking switch knob is difficult to press the switches surfaces vertically. Thus, it is preferred that the rocking fulcrum is provided near the switch surfaces of the tactile switches.

From a viewpoint of operability of the rocking switch knob, it is required that a pressing direction of the rocking switch knob is approximately perpendicular to an operating panel of the operating device. However, when the distance between an operating surface provided at the rocking switch knob and the rocking fulcrum becomes long, the operating surface may be pressed obliquely because the switch knob rotates on the rocking fulcrum. Thereby, the operability of the switch knob is reduced. Thus, it is preferred that the rocking fulcrum is provided near the operating surface of the switch knob.

However, in the seesaw switch that is attached to an operating panel for operating the electronic apparatus installed in the vehicle, a distance between the rocking switch knob and the tactile switches becomes long, for example, due to a design. In the present case, if the rocking fulcrum of the rocking switch knob is provided near the operating surface of the rocking switch knob, the rocking fulcrum is away from the switch surfaces of the tactile switches. In contrast, if the rocking fulcrum is provided near the switch surfaces of the tactile switches, the rocking fulcrum is away from the operating surface of the rocking switch knob. Thus, it is difficult to ensure compatibility of pressing the tactile switches with a high degree of certainty and improving the operability of the rocking switch knob.

In a rocking switch unit according to a first example of the related art, as shown in FIG. 22, a switch knob 2 includes a knob body 20 and switch-pressing portions 210*a* and 210*b* that are disposed on longitudinal end portions of the knob body 20. The switch-pressing portions 210*a* and 210*b* protrude toward switch surfaces of tactile switches 5*a* and 5*b*. In the present case, a rocking fulcrum 420 is located near an operating surface of the switch knob 2. Thus, an operability of the switch knob 2 is ensured.

However, a distance L1 between the rocking fulcrum 420 and ends of the switch-pressing portions 210*a* and 210*b* are long. Thus, when the switch knob 2 is pressed, the ends of the switch-pressing portions 210*a* and 210*b* rotate on the rocking fulcrum 420 provided at a base section 400A, and thereby, the switch-pressing portions 210*a* and 210*b* are difficult to press the switch surfaces of the tactile switches 5*a* and 5*b* vertically. Thus, even when the user presses the switch knob 2, the tactile switches 5*a* and 5*b* are not pressed vertically, and the user is difficult to receive the operation feeling.

In a rocking switch unit according to a second example of the related art, as shown in FIG. 23, seesaw pins 600*a* and 600*b* are disposed between the switch knob 2 and the tactile switches 5*a* and 5*b*. When one of rocking end portions 21*a* and 21*b* of the switch knob 2 is pressed, rear ends of the rocking end portions 21*a* and 21*b* press down corresponding seesaw pins 600*a* and 600*b*, and thereby the switch surfaces of the tactile switches 5*a* and 5*b* are pressed. A base section 400B has the rocking fulcrum 420 of the switch knob 2 and guide portions 410*a* and 410*b* for guiding a movement of the seesaw pins 600*a* and 600*b* in the pressing direction. Thus, the seesaw pins 600*a* and 600*b* can press the switch surfaces of the tactile switches 5*a* and 5*b* vertically.

In the present case, one of lower surfaces of the rocking end portions 21*a* and 21*b* that is located at a releasing position is away from an upper surface of the corresponding seesaw pins 600*a* and 600*b*, as shown in FIG. 23. For example, when the rocking end portion 21*b* located at the releasing position is pressed so that the seesaw pin 600*b* press the tactile switch 5*b*, the lower end of the rocking end portion 21*b* hits the upper surface of the seesaw pin 600*b* and generates an unpleasant hitting noise. In addition, the present seesaw switch requires two seesaw pins 600*a* and 600*b* corresponding to the tactile switches 5*a* and 5*b*. Thus, the number of components increases and an assembling efficiency is reduced.

JP-10-125179A discloses a rocking switch unit shown in FIG. 24. The rocking switch unit includes a switch knob 2, tactile switches 5*a* and 5*b*, a seesaw holder 300C, and a base section 400C. The seesaw holder 300C has switch-pressing portions 310*a* and 310*b* at longitudinal end portions thereof. The base section 400C has a first rocking fulcrum 420 and a second rocking fulcrum 430 coaxially arranged in a pressing direction of the switch knob 2. The switch knob 2 is attached to the first rocking fulcrum 420, and the seesaw holder 300C are attached to the second rocking fulcrum 430 that is arranged between the switch knob 2 and the tactile switches 5*a* and 5*b*. The switch knob 2 has a knob body 20 and rocking end portions 21*a* and 21*b* disposed at longitudinal end portions of the knob body 20. Because the rocking end portions 21*a* and 21*b* constantly contact the seesaw holder 300C, a hitting noise is not generated. In addition, the tactile switches 5*a* and 5*b* can be pressed even through the switch knob 2 is away from the tactile switches 5*a* and 5*b*.

In the present rocking switch unit, the switch knob 2 rotates on the first rocking fulcrum 420, and the seesaw holder 300C rotates on the second rocking fulcrum 430. Thus, when a distance L2 between the first rocking fulcrum 420 and lower surfaces of the switch-pressing portions 310*a* and 310*b*, and a distance L3 between the second rocking fulcrum 430 and the lower surfaces of the switch-pressing portions 310*a* and 310*b* increase, the switch-pressing portions 310*a* and 310*b* are difficult to press the switch surfaces of the tactile switches 5*a* and 5*b* vertically.

JP-2006-40562A discloses a seesaw switch that includes a switch knob, seesaw pins and spring members that are disposed between longitudinal end portions of the switch knob and the seesaw pins. In the present case, a hitting noise is not generated. However, the number of components increases and an assembling efficiency is reduced.

SUMMARY OF THE INVENTION

In view of the foregoing problems, it is an object of the present invention to provide a rocking switch unit in which tactile switches can be pressed with a high degree of certainty even in a case where a switch knob is away from switch surfaces of the tactile switches.

According to an aspect of the invention, a rocking switch unit includes a base section, a switch knob, a pair of tactile switches, a middle rocking section, and a pair of switch-pressing portions. The base section has a first rocking fulcrum and a second rocking fulcrum. The switch knob is coupled with the base section through the first rocking fulcrum to be rockable in two ways and has a pair of rocking end portions located on two sides with respect to the first rocking fulcrum. The tactile switches are disposed to correspond to the pair of rocking end portions. The middle rocking section is coupled with the based section through the second rocking fulcrum to be rockable in the two ways in conjunction with the switch knob and has a rocking pole extending toward two sides with respect to the second fulcrum and having a pole rocking surface crossing a pressing direction. The switch-pressing portions are located between the pair of the rocking end portions and the pair of the tactile switches for transmitting a pressing force from one of the rocking end portions to the corresponding tactile switch when the one of the rocking end portions is pressed in the pressing direction. The switch-pressing portions respectively have an end rocking surface crossing the pressing direction and are coupled with two end portions of the rocking pole in such a manner that a coupling angle between the pole rocking surface and end rocking surfaces is variable in the pressing direction.

In the present rocking switch unit, when one of the rocking end portions is pressed, the switch-pressing portions are rotatable with respect to the middle rocking section. Thus, the switch-pressing portions can be linearly movable toward the tactile switches. As a result, switch surfaces of the tactile switches are pressed vertically, and thereby an operability of the switch knob and an operation feeling can be ensured. Furthermore, in the present rocking switch unit, even when the switch-pressing portions are long in the pressing direction, the switch-pressing portions can transfer the pressing force to the switch surfaces of the tactile switches linearly. When the middle rocking section attached with the pair of switch-pressing portions is used, the number of components is reduced compared with a case where seesaw pins are used. Thus, an assembling efficiency is improved.

BRIEF DESCRIPTION OF THE DRAWINGS

Additional objects and advantages of the present invention will be more readily apparent from the following detailed description of preferred embodiments when taken together with the accompanying drawings. In the drawings.

DETAILED DESCRIPTION OF THE PREFERRED EMBODIMENTS

First Embodiment

Figure 1:
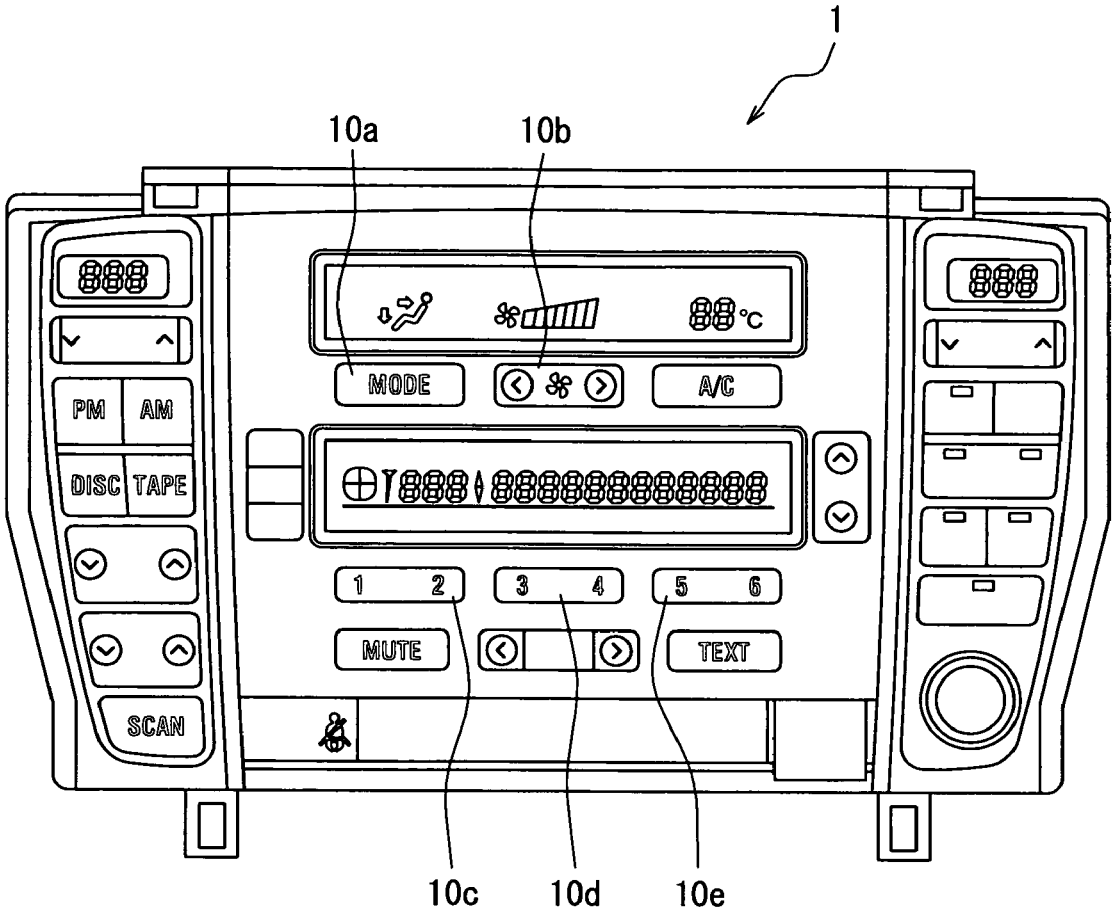
FIG. 1 is a front view showing an example of a front panel of a vehicle.

A rocking switch unit 10 according to a first embodiment of the invention can be used as first to fifth rocking switch units 10*a*-10*e* disposed at a front panel 1 shown in FIG. 1. The first rocking switch unit 10*a* is provided for switching an outlet vent of conditioned air. The second rocking switch unit 10*b* is provided for changing a flow amount of conditioned air. The third to fifth rocking switch units 10*c*-10*e* are provided for selecting music of an audio device. The front panel 1 further includes a display and other switch units for controlling an on-board electronic apparatus including an air-conditioning device and the audio device. The on-board electronic apparatus can be controlled by operating the switch units including the first to fifth rocking switch units 10*a*-10*e*. An exemplary configuration of the rocking switch unit 10 including the first to fifth rocking switch units 10*a*-10*e* will now be described with reference to FIGS. 1-8.

The rocking switch unit 10 includes a base section 4, a switch knob 2, a pair of tactile switches 5*a* and 5*b*, and a pressing joint 3. The switch knob 2 is attached to the base section 4 through a first rocking fulcrum 42 to be rockable in two ways. The tactile switches 5*a* and 5*b* are push-type switch elements respectively provided for corresponding to rocking end portions 21*a* and 21*b* of the switch knob 2. The pressing joint 3 is attached to the base section 4 through a second rocking fulcrum 43 to be rockable in the two ways in conjunctions with the switch knob 2. When one of the rocking end portions 21*a* and 21*b* of the switch knob 2 is pressed to the pressing joint 3, the pressing joint 3 transmits a pressing force to the tactile switches 5*a* and 5*b*. That is, when one of the rocking end portions 21*a* and 21*b* disposed at two longitudinal ends of the switch knob 2 is pressed to the pressing joint 3, switch-pressing portions 31*a* and 31*b* of the pressing joint 3 displace toward the tactile switches 5*a* and 5*b*, respectively.

Figure 2:
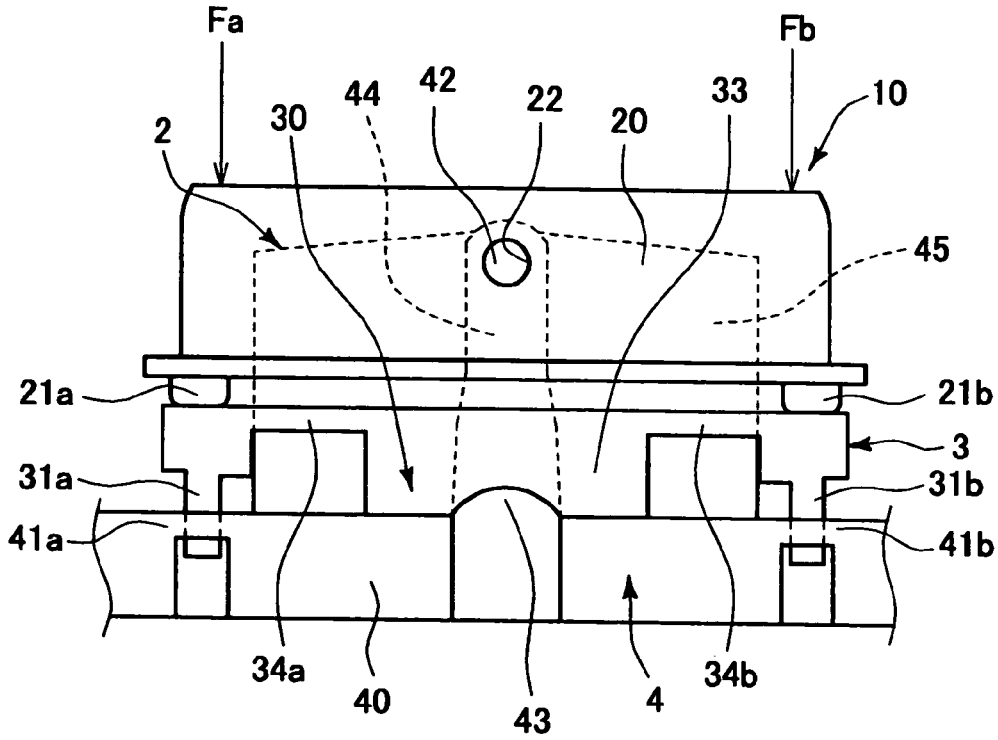
FIG. 2 is a front view showing a rocking switch unit according to a first embodiment of the invention.
Figure 4:
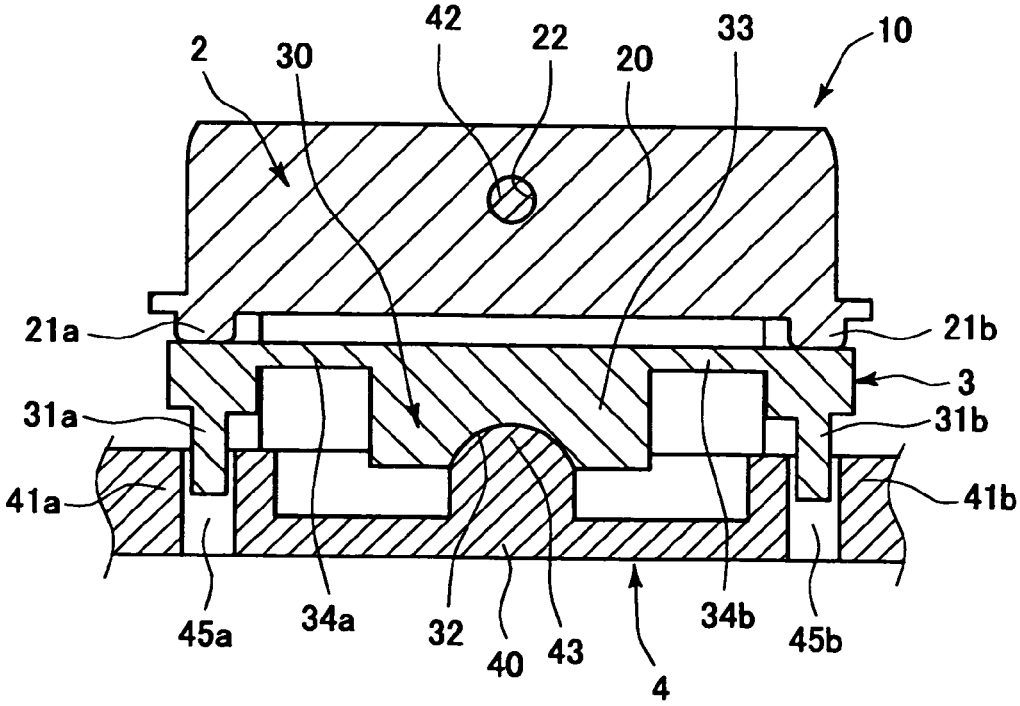
FIG. 4 is a cross-sectional view showing the rocking switch unit shown in FIG. 2.
Figure 3:
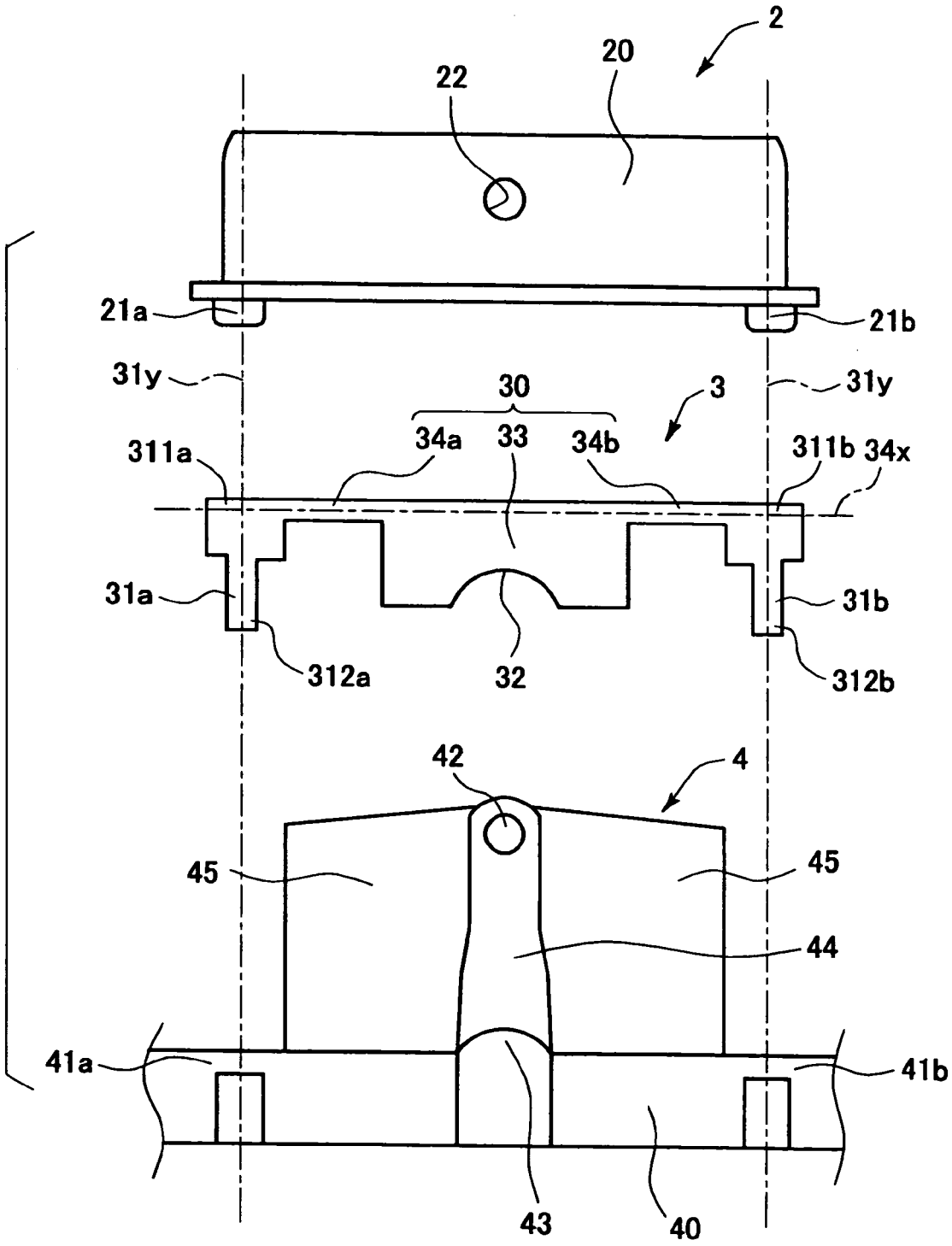
FIG. 3 is an exploded view showing the rocking switch unit shown in FIG. 2.

The switch knob 2 includes a knob body 20, the rocking end portions 21*a* and 21*b*, and an attachment hole 22. The switch knob 2 is made of an acrylonitrile butadiene styrene resin (ABS resin) and is formed by injection molding, for example. Now, an upper side and a lower side of the rocking switch unit 10 shown in FIG. 2 is defined as a front side and rear side, respectively, for the sake of convenience. The knob body 20 has a hollow flange shape. At a front surface of the knob body 20, pressing force is applied in directions shown by the arrows Fa and Fb. A rear side of the knob body 20 is open. The rocking end portions 21*a* and 21*b* are formed at rear end portions of the knob body 20 to have a predetermined interval therebetween in a longitudinal direction. Each of the rocking end portions 21*a* and 21*b* protrudes toward the rear side (i.e., pressing direction). The attachment hole 22 is provided at a middle portion of the knob body 20 in the longitudinal direction. As shown in FIG. 3, the first rocking fulcrum 42 has an approximately circular shape in cross section and protrudes in a direction approximately perpendicular to the longitudinal direction of the switch knob 2 and the pressing direction. The first rocking fulcrum 42 is inserted into the attachment hole 22 to be rotatable. Thus, the switch knob 2 is rockable on the rocking fulcrum 42.

Figure 7A:
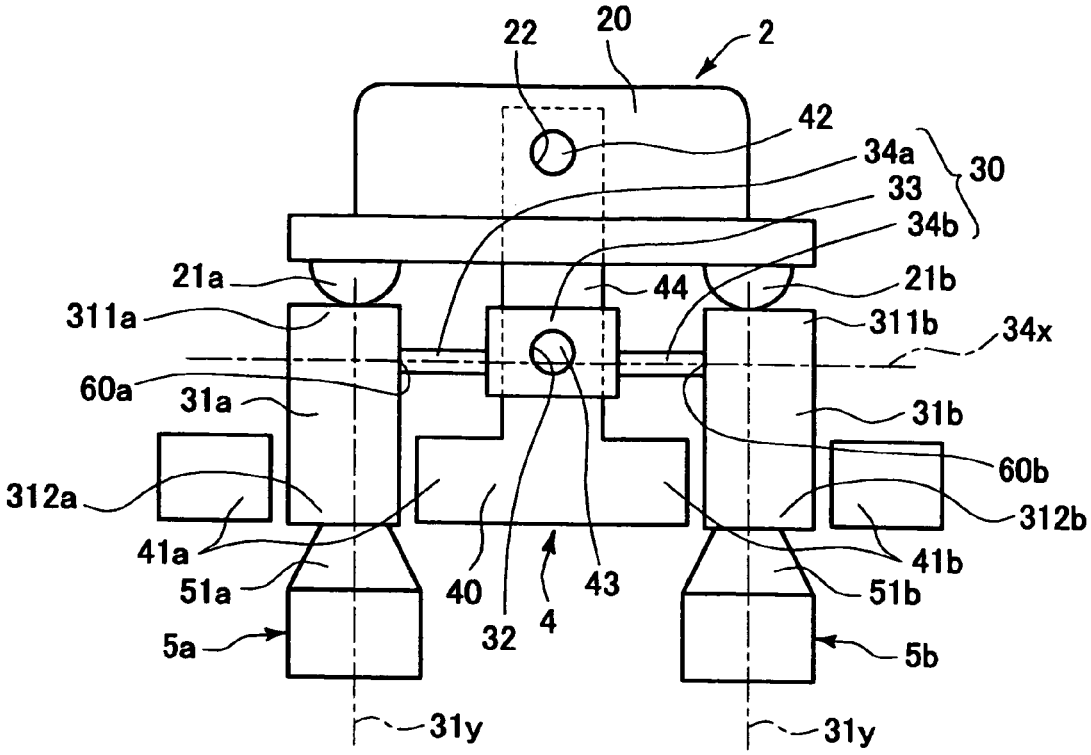
FIGS. 7A and 7B are schematic diagrams each showing the rocking switch unit shown in FIG. 2.
Figure 7B:
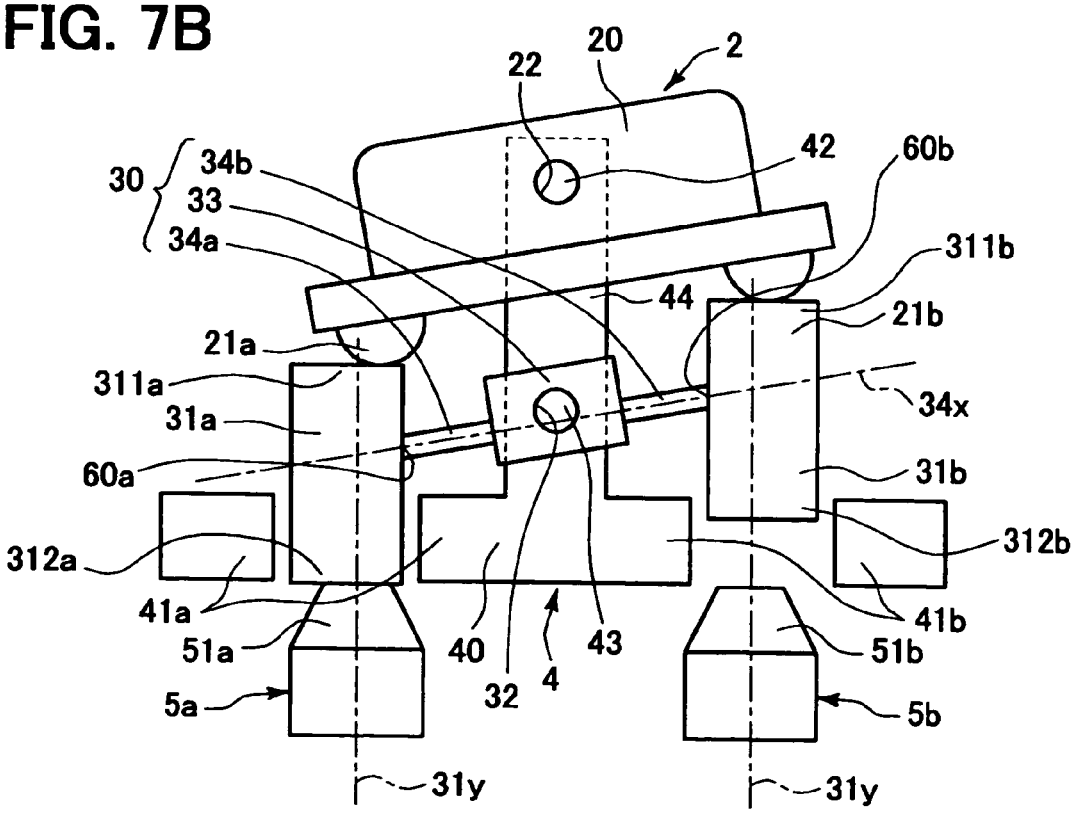

As shown in FIGS. 7A and 7B, the tactile switches 5*a* and 5*b* are provided at the rear side of the rocking end portions 21*a* and 21*b* of the switch knob 2, respectively. The tactile switches 5*a* and 5*b* are arranged in the base section 4 to have a predetermined interval therebetween in a predetermined direction, that is, a right-and-left direction in FIG. 2. When a pressing and a releasing of the rocking end portions 21*a* and 21*b* are switched, conductive states of the tactile switches 5*a* and 5*b* are switched. Each of the tactile switches 5*a* and 5*b* has an operation-feeling generating element that generates operation feeling (feeling of a click) when front end portions 51*a* and 51*b* of the tactile switches 5*a* and 5*b* each having a switch surface are pressed respectively.

Figure 8:
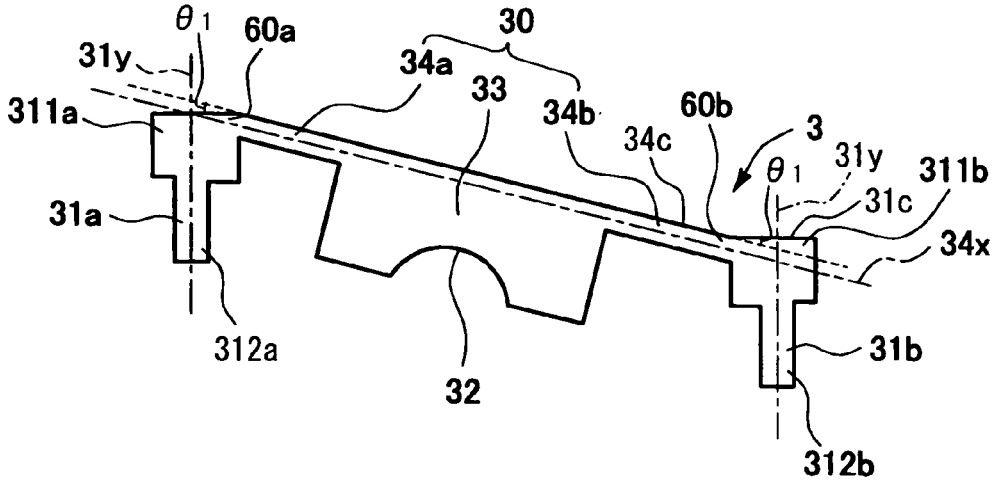
FIG. 8 is a front view showing the pressing joint which is in a pressing position.

As shown in FIG. 3, the pressing joint 3 includes a middle rocking section 30 and the switch-pressing portions 31*a* and 31*b*. The pressing joint 3 is made of ABS resin, for example. Because the pressing joint 3 cannot be seen from an outside of the rocking switch knob 10 and is not contact the outside of the rocking switch unit 10, the pressing joint 3 is not affected by the design. The material of the pressing joint 3 is selected from materials having a high elasticity. The middle rocking section 30 has a fulcrum coupling part 33 at a middle portion thereof. The fulcrum coupling part 33 is coupled with the second rocking fulcrum 43 to be rockable. The middle rocking section 30 further includes rocking poles 34*a* and 34*b* which extend toward two sides with respect to the fulcrum coupling part 33. The switch-pressing portions 31*a* and 31*b* are coupled with the middle rocking section 30 at two ends of the middle rocking section 30. The switch-pressing portions 31*a* and 31*b* respectively protrude toward the tactile switches 5*a* and 5*b* to contact the tactile switches 5*a* and 5*b*. Furthermore, the switch-pressing portions 31*a* and 31*b* have pressing-force receiving parts 311*a* and 311*b*, respectively, on a side of the switch knob 2. The pressing-force receiving parts 311*a* and 311*b* constantly contact the rocking end portions 21*a* and 21*b* for receiving the pressing force applied to the switch knob 2. As shown in FIG. 8, the middle rocking section 30 has a middle rocking surface (pole rocking surface) 34*c* at a front side thereof, that is, on the side of the switch knob 2. In addition, each of the switch-pressing portions 31*a* and 31*b* has an end rocking surface 31*c* on a front side thereof. The middle rocking surface 34*c* and the end rocking surface 31*c* cross the pressing direction of the switch knob 2. When the pressing joint 3 is rocked and one of the switch-pressing portions 31*a* and 31*b* approaches a pressing position, a coupling angle $\theta_1$ between the middle rocking surface 34*c* and the end rocking surface 31*c* increases.

Specifically, when one of the switch-pressing portions 31*a* and 31*b*, which are integrated at the two end portions of the middle rocking section 30, is pressed toward the corresponding tactile switches 5*a* or 5*b*, the rocking poles 34*a* and 34*b* are elastically deformed. Thereby, the coupling angle $\theta_1$ between the middle rocking surface 34*c* of the middle rocking section 30 and the end rocking surfaces 31*c* of the switch-pressing portions 31*a* and 31*b* changes. The rocking poles 34*a* and 34*b* are provided as a single elastic beam having a plate shape, for example. When the rocking poles 34*a* and 34*b* have a plate shape, an integrated structure of the middle rocking section 30 and the switch-pressing portions 31*a* and 31*b* becomes a simple and a predetermined beam strength can be ensured. When the single elastic beam has a first dimension in a direction approximately parallel to the middle rocking surface (i.e., pole rocking surface) and a second dimension in the pressing direction, the first dimension is larger than the second dimension. In the present case, the pressing joint 3 is constructed with the middle rocking section 30 and the switch-pressing portions 31*a* and 31*b* that are integrally formed by injection molding of resin. Alternatively, the rocking poles 34*a* and 34*b* may be made of metal, and the pressing joint 3 may be formed by insert molding of metal.

Figure 5A:
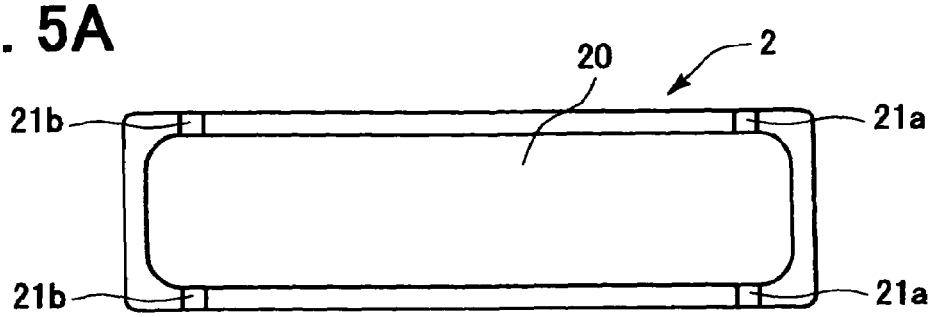
FIG. 5A is a bottom view of a switch knob.
Figure 5B:
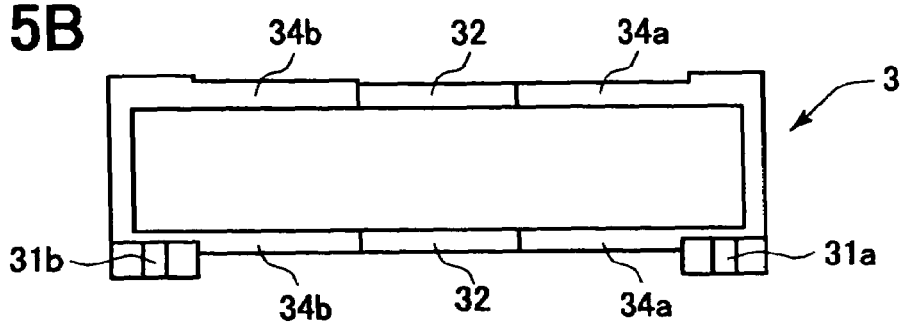
FIG. 5B is a bottom view of a pressing joint.
Figure 5C:
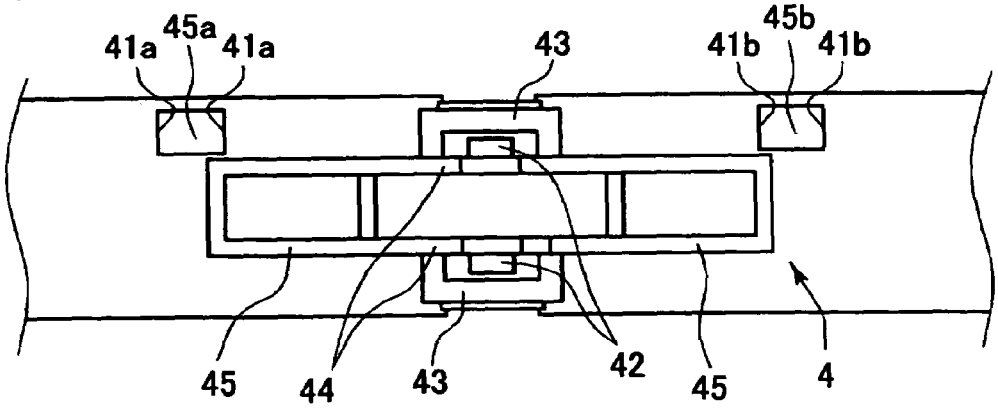
FIG. 5C is a plan view of a base section.
Figure 6:
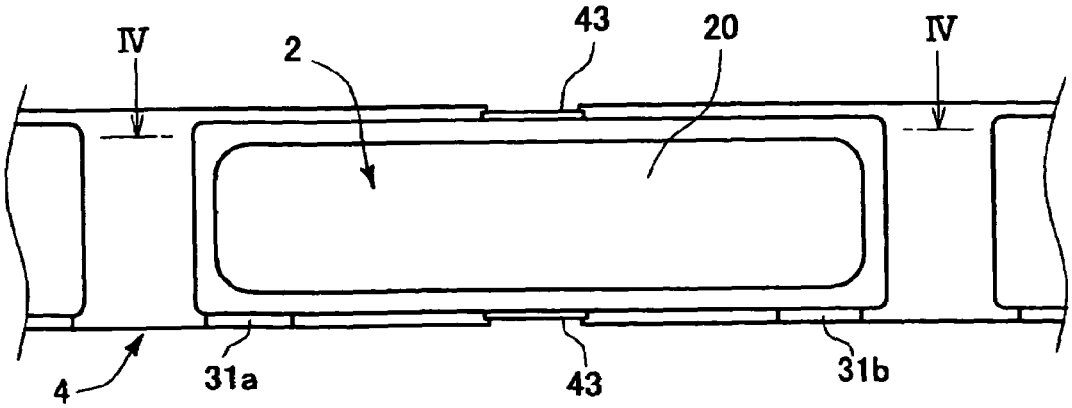
FIG. 6 is a plan view showing the rocking switch unit shown in FIG. 2.

The base section 4 includes a fulcrum-forming portion 44 and base portion 40, and is formed by injection molding of ABS resin, for example. The first rocking fulcrum 42 and the second rocking fulcrum 43 are formed in the fulcrum-forming portion 44. The base portion 40 extends from the fulcrum-forming portion 44 in the longitudinal direction of the switch knob 2 and each of the rocking poles 34*a* and 34*b* of the middle rocking section 30. As shown in FIG. 5C, the first rocking fulcrum 42 has an approximately circular shape in cross section and protrudes in a direction approximately perpendicular to the longitudinal direction of the switch knob 2 and the pressing direction. The first rocking fulcrum 42 is inserted into the attachment hole 22 of the switch knob 2. The second rocking fulcrum 43 is provided at the fulcrum-forming portion 44 approximately coaxially with the first rocking fulcrum 42 in the pressing direction. In addition, the second rocking fulcrum 43 has a cylindrical curved surface and an axis approximately perpendicular to the longitudinal direction of the switch knob 2 and the pressing direction. The fulcrum coupling part 33 of the middle rocking section 30 has a curved recess part 32 on a rear side thereof. The curved recess part 32 is disposed on the cylindrical curved surface of the second rocking fulcrum 43.

The base portion 40 has switch-pressing guide parts 41*a* and 41*b* each having a guide hole 45*a* and 45*b*. The switch-pressing guide parts 41*a* and 41*b* are provided so that the switch-pressing portions 31*a* and 31*b* can move linearly between a releasing position (central figure in FIG. 3) at which, the switch knob 2 is in a neutral position and a pressing position (FIG. 8) at which the switch-pressing portions 31*a* and 31*b* press the tactile switches 5*a* and 5*b*, respectively. In the guide holes 45*a* and 45*b*, the tactile switches 5*a* and 5*b* corresponding to the switch-pressing portions 31*a* and 31*b* are disposed in such a manner that the switch surfaces of the front end portions 51*a* and 51*b* oppose the switch-pressing portions 31*a* and 31*b* in the pressing direction.

The switch-pressing guide parts 41*a* and 41*b* are provided so that the switch-pressing portions 31*a* and 31*b* can move linearly between the releasing position and the pressing position. As shown in FIG. 8, when the rocking poles 34*a* and 34*b* of the middle rocking section 30 are elastically deformed and one of the switch-pressing portions 31*a* and 31*b* approaches the pressing position, the coupling angle $\theta_1$ between the middle rocking surface 34*c* and the end rocking surface 31*c* increases. The tactile switches 5*a* and 5*b* changes the switch knob 2 from the releasing position (central figure in FIG. 3) to the pressing position (FIG. 8) through the switch-pressing portions 31*a* and 31*b*.

The fulcrum-forming portion 44 protrudes from a surface of the base portion 40 on a side where the switch knob 2 and the middle rocking section 30 are located to an opposite side of the tactile switches 5*a* and 5*b* are located in an almost similar direction with the pressing direction. That is, the fulcrum-forming portion 44 protrudes from the surface of the base portion 40 to the front side. A first distance between the first rocking fulcrum 42 and the base portion 40 is longer than a second distance between the second rocking fulcrum 43 and the base portion 40. In the present case, the middle rocking section 30 is disposed between the switch knob 2 and the tactile switches 5*a* and 5*b*. Thus, the middle rocking section 30 a can provide a stroke between the switch knob 2 and the tactile switches 5*a* and 5*b*.

In addition, the first rocking fulcrum 42 and the second rocking fulcrum 43 are provided at the fulcrum-forming portion 44 approximately coaxially in the pressing direction of the switch knob 2. The fulcrum-forming portion 44 has a reinforcing part 45 that extends toward two sides in the longitudinal direction of the switch knob 2. Thereby, the whole fulcrum-forming portion 44 is reinforced. As shown in FIG. 5A, the rear side of the knob body 20 is open so that the fulcrum-forming portion 44, which includes the reinforcing part 45, is housed in the switch knob 2 from the rear side. The pressing joint 3 extends in the pressing direction of the switch knob 2 and surrounds the fulcrum-forming portion 44.

As described above, in the rocking switch unit 10, the switch knob 2 is attached to the base section 4 through the first rocking fulcrum 42 to be rockable in the two ways. The pair of the tactile switches 5*a* and 5*b* is disposed to correspond to the rocking end portions 21*a* and 21*b* of the switch knob 2, respectively. The switch-pressing portions 31*a* and 31*b* are disposed between the rocking end portions 21*a* and 21*b* and the tactile switches 5*a* and 5*b*, respectively. When one of the rocking end portions 21*a* and 21*b* is pressed, the pressing force is transmitted to the tactile switches 5*a* and 5*b* through the switch-pressing portions 31*a* and 31*b*. The switch-pressing portions 31*a* and 31*b* are attached at the end portions of the rocking poles 34*a* and 34*b* in such a manner that the coupling angle $\theta_1$ between the middle rocking surface 34*c* of the middle rocking section 30 and the end rocking surfaces 31*c* of the switch-pressing portions 31*a* and 31*b* is variable. The middle rocking section 30 is attached to the base section 4 through the second rocking fulcrum 43 to be rockable in the two ways in conjunction with the switch knob 2.

In the present case, the middle rocking surface 34*c* is located approximately perpendicularly to a rotation axis (rocking axis) of the middle rocking section 30 and extends to a rocking radial direction of the middle rocking section 30. The coupling angle $\theta_1$ is a crossing angle of the middle rocking surface 34*c* and the end rocking surface 31*c*.

The rocking poles 34*a* and 34*b* of the middle rocking section 30 function as angle-changing portions that enables to change the coupling angle $\theta_1$ between the middle rocking section 30 and the switch-pressing portions 31*a* and 31*b*. Specifically, the angle-changing portions are parts of the rocking poles 34*a* and 34*b* that deform elastically. In the present embodiment, as shown in FIGS. 3 and 8, outer end parts 60*a* and 60*b* of the rocking poles 34*a* and 34*b* function as the angle-changing portions.

When the angle-changing portions deform elastically, the coupling angle $\theta_1$ and a crossing angle between an extending axis 34*x* of the middle rocking section 30 and a protruding axis 31*y* of the switch-pressing portions 31*a* and 31*b* changes. Thus, the switch-pressing portions-31*a* and 31*b*, which are coupled with the middle rocking section 30, are movable toward the tactile switches 5*a* and 5*b* in the pressing directions Fa and Fb, respectively. Thereby, the pressing force applied to the switch knob 2 can be linearly transmitted to the pressing surfaces of the tactile switches 5*a* and 5*b*. The extending axis 34*x* is an axis that connects the both end of the middle rocking section 30 in the rocking radial direction. The switch-pressing portions 31*a* and 31*b* have transmit parts 312*a* and 312*b* on a side of the tactile switches 5*a* and 5*b*, respectively. The transmit parts 312*a* and 312*b* protrude toward the tactile switches 5*a* and 5*b* along the protruding axis 31*y*. End surfaces of the switch-pressing portions 31*a* and 31*b* oppose the pressing surface of the tactile switches 5*a* and 5*b*, respectively, to be approximately parallel to each other, as shown in FIGS. 7A and 7B.

Figure 14:
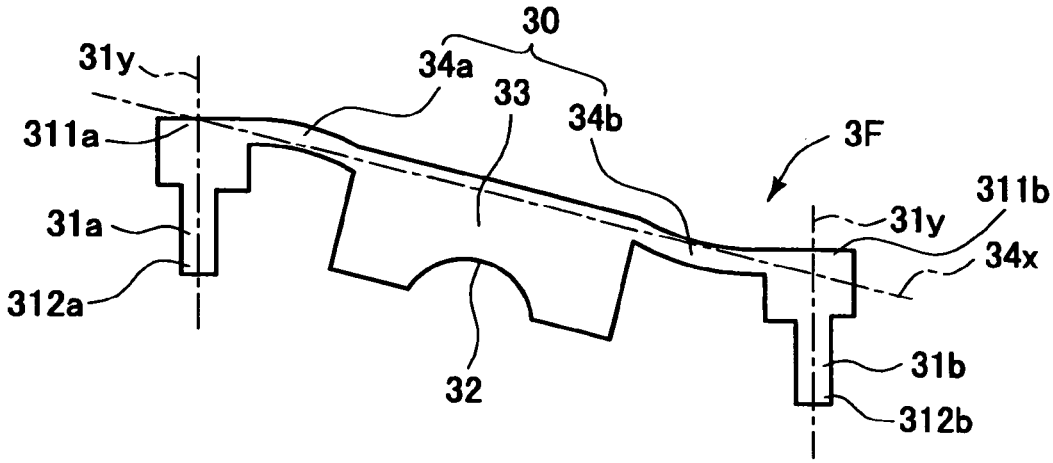
FIG. 14 is a front view showing a pressing joint according to a first modification of the first embodiment.
Figure 15:
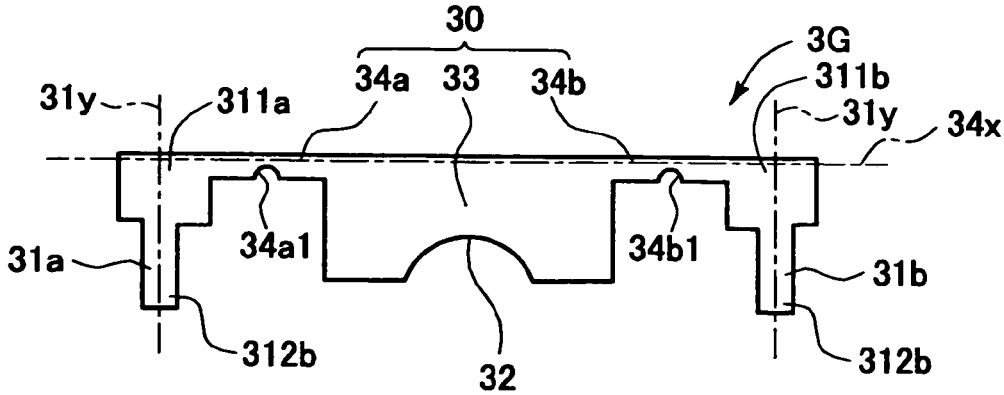
FIG. 15 is a front view showing a pressing joint according to a second modification of the first embodiment.

In the pressing joint 3 shown in FIG. 8, the angle-changing portions are located at the outer end parts 60*a* and 60*b* of the middle rocking section 300, as an example. Alternatively, the angle-changing portions may be located at other parts. For example, the angle-changing portions may be located on a side of the fulcrum coupling part 33 with respect to the outer end parts 60*a* and 60*b*. Alternatively, as shown in a pressing joint 3F in FIG. 14, whole of the rocking poles 34*a* and 34*b* may be function as the angle-changing portions. Alternatively, each of the rocking poles 34*a* and 34*b* may have a part that can deform elastically easier than the other part to provide the angle-changing portion. For example, as shown in a pressing joint 3G in FIG. 15, the rocking poles 34*a* and 34*b* may have recess parts 34*a*1 and 34*b*1, respectively. The recess parts 34*a*1 and 34*b*1 are thinner than the other part. Thus, the recess parts 34*a*1 and 34*b*1 can deform elastically easier than the other part. Alternatively, a part that can deform elastically may be made of a high-modulus material compared with the other part.

Figure 16:
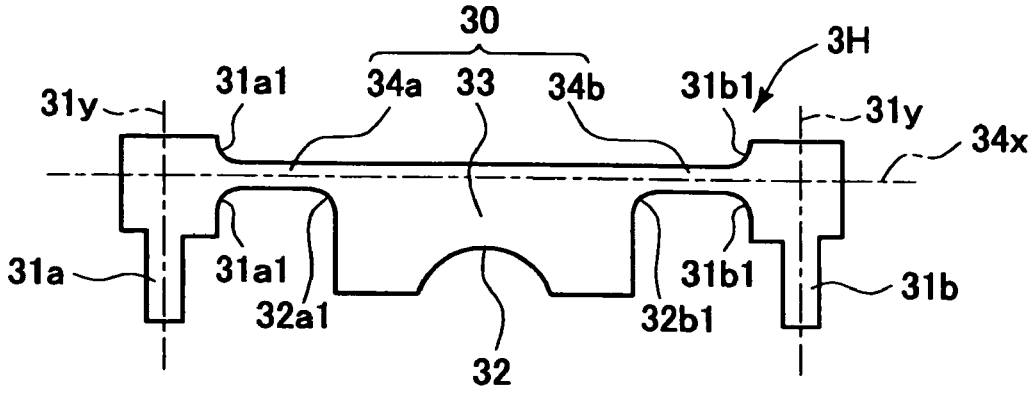
FIG. 16 is a front view showing a pressing joint according to a third modification of the first embodiment.
Figure 17:
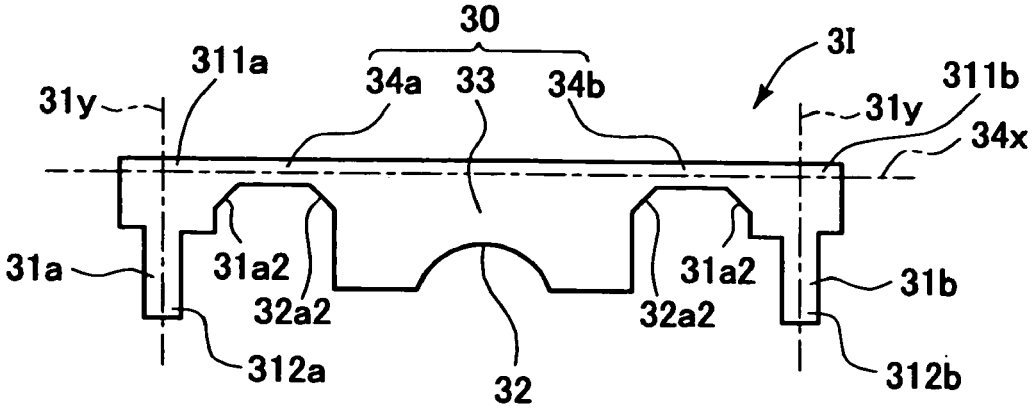
FIG. 17 is a front view showing a pressing joint according to a fourth modification of the first embodiment.

Alternatively, as shown in a pressing joint 3H in FIG. 16, the rocking pole 34*a* may have curved surfaces 31*a*1 and 32*a*1 at a coupling part between the rocking pole 34*a* and the switch-pressing portion 31*a* and a coupling part between the rocking pole 34*a* and the fulcrum coupling part 33, respectively, and the rocking pole 34*b* may have curved surfaces 31*b*1 and 32*b*1 at a coupling part between the rocking pole 34*b* and the switch-pressing portion 31*b* and a coupling part between the rocking pole 34*b* and the fulcrum coupling part 33, respectively. Thereby, outer peripheral surfaces of the coupling parts are formed to be smooth. Alternatively, as shown in a pressing joint 31 in FIG. 17, the rocking pole 34*a* may have tapered surfaces 31*a*2 and 32*a*2 at the coupling part between the rocking pole 34*a* and the switch-pressing portion 31*a* and the coupling part between the rocking pole 34*a* and the fulcrum coupling part 33, respectively, and the rocking pole 34*b* may have tapered surfaces 31*a*2 and 32*a*2 at the coupling part between the rocking pole 34*b* and the switch-pressing portion 31*b* and the coupling part between the rocking pole 34*b* and the fulcrum coupling part 33, respectively. The above-described structures may be combined with each other.

In the present rocking switch unit 10, when one of the rocking end portions 21*a* and 21*b* is pressed, the switch-pressing portions 31*a* and 31*b* are rotatable with respect to the middle rocking section 30. Thus, the switch-pressing portions 31*a* and 31*b* can be linearly movable toward the tactile switches 5*a* and 5*b*. As a result, the switch surfaces of the tactile switches 5*a* and 5*b* are pressed vertically, and thereby an operability of the switch knob and an operation feeling can be ensured. Furthermore, by using middle rocking section 30 attached with the pair of switch-pressing portions 31*a* and 31*v*, the number of components is reduced compared with a case where seesaw pins are used. Thus, an assembling efficiency is improved.

In addition, because the switch-pressing guide parts 41*a* and 41*b* are provided, the transmit parts 312*a* and 312*b* of the switch-pressing portions 31*a* and 31*b* can vertically press the switch surface of the tactile switches 5*a* and 5*b* with a high degree of certainty, and a user can receive the operation feeling.

The base section 4 includes a base portion 40. The base portion 40 supports the fulcrum-forming portion 44 at which the first rocking fulcrum 42 and the second rocking fulcrum 43 are disposed. Furthermore, the base portion 40 can easily provide the guide holes 45*a* and 45*b* as through holes.

Second Embodiment

Figure 9:
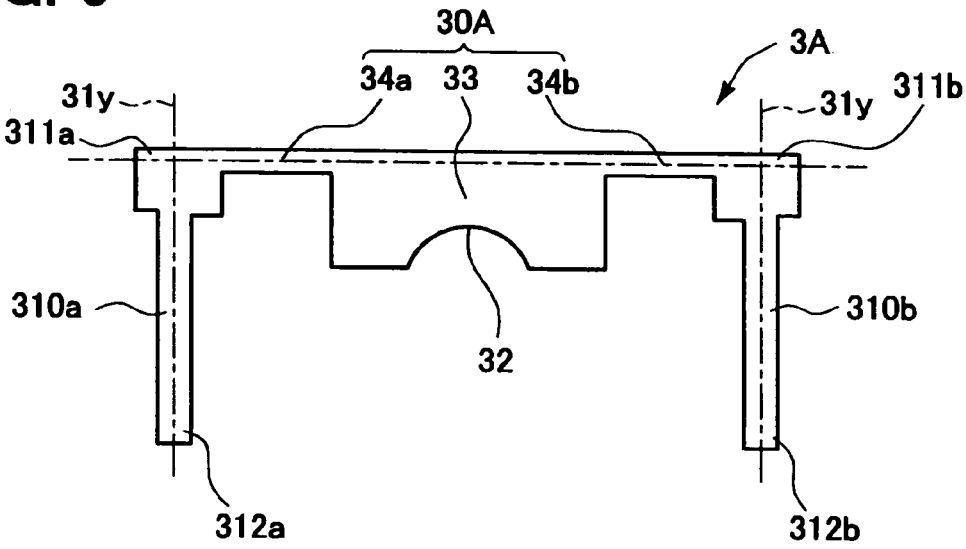
FIG. 9 is a front view showing a pressing joint according to a second embodiment of the invention.

In the rocking switch unit 10 according to the first embodiment, the rocking poles 34*a* and 34*b* of the middle rocking section 30 can deform elastically. Thereby, the switch-pressing portions 31*a* and 31*b* can move linearly in the guide holes 45*a* and 45*b* of the switch-pressing guide parts 42*a* and 42*b* to approach or separate from the corresponding tactile switches 5*a* and 5*b*, respectively, while keeping a state where the switch-pressing portions 31*a* and 31*b* protrude in the pressing direction of the switch knob 2. A pressing joint 3A according to a second embodiment invention has a middle rocking section 30A and switch-pressing portions 310*a* and 310*b*, as shown in FIG. 9. The middle rocking section 30A is almost similar with the middle rocking section 30 in the pressing joint 3, and the switch-pressing portions 310*a* and 310*b* are longer than the switch-pressing portions 31*a* and 31*b* in the pressing joint 3. Also in the present case, the switch-pressing portions 310*a* and 310*b* can linearly approach or separate from the corresponding tactile switches 5*a* and 5*b*, respectively, while keeping a state where the switch-pressing portions 310*a* and 310*b* protrude in the pressing direction of the switch knob 2, due to the elastic deformation of the rocking poles 34*a* and 34*b* of the middle rocking section 30A.

The present structure can be suitably used in a case where a distance between the switch knob 2 and the tactile switches 5*a* and 5*b* becomes long due to a design. When the switch-pressing portions 31*a* and 31*b* become long in the pressing direction, the switch-pressing guide parts 42*a* and 42*b* are required to have long guide holes 45*a* and 45*b*, respectively.

Third Embodiment

Figure 10:
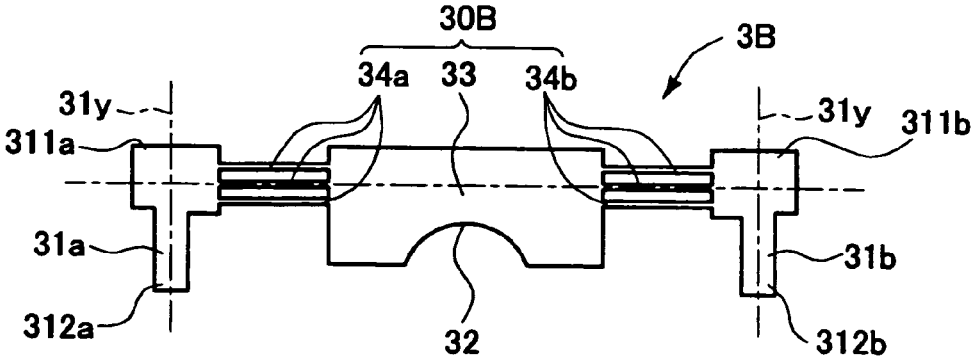
FIG. 10 is a front view showing a pressing joint according to a third embodiment of the invention.

A pressing joint 3B according to a third embodiment of the invention has a middle rocking section 30B, as shown in FIG. 10. The middle rocking section 30B has the rocking poles 34*a* and 34*b* each constructed with a plurality pole elements, for example, three pole elements. The pole elements extend in a direction approximately parallel to the middle rocking surface 34*c*, and are separated from each other in the pressing direction. When each of the pole elements has a first dimension in the extending direction and a second dimension in the pressing direction, the first dimension is larger than the sum of the second dimensions of all the pole elements. When the rocking poles 34*a* and 34*b* are constructed with plurality pole elements, the strength of the middle rocking section 30B increases.

Fourth Embodiment

In the first to third embodiments, the switch-pressing portions 31*a* and 31*b* are integrated with the middle rocking section 30. Because the middle rocking section 30 can deform elastically, the switch-pressing directions 31*a* and 31*b* can move toward the tactile switches 5*a* and 5*b* in the pressing direction Fa and Fb while changing the coupling angle $\theta_1$ between the middle rocking surface and the end rocking surface and the crossing angle between the extending axis 34*x* and the protruding axis 31*y*. That is, the angle-changing portions are located at the middle rocking section 30. Alternatively, in a case where the middle rocking section 30 and the switch-pressing portions 31*a* and 31*b* are formed separately, the angle-changing portions may be located at coupling part between the middle rocking section 30 and the switch-pressing portions 31*a* and 31*b*.

Figure 11:
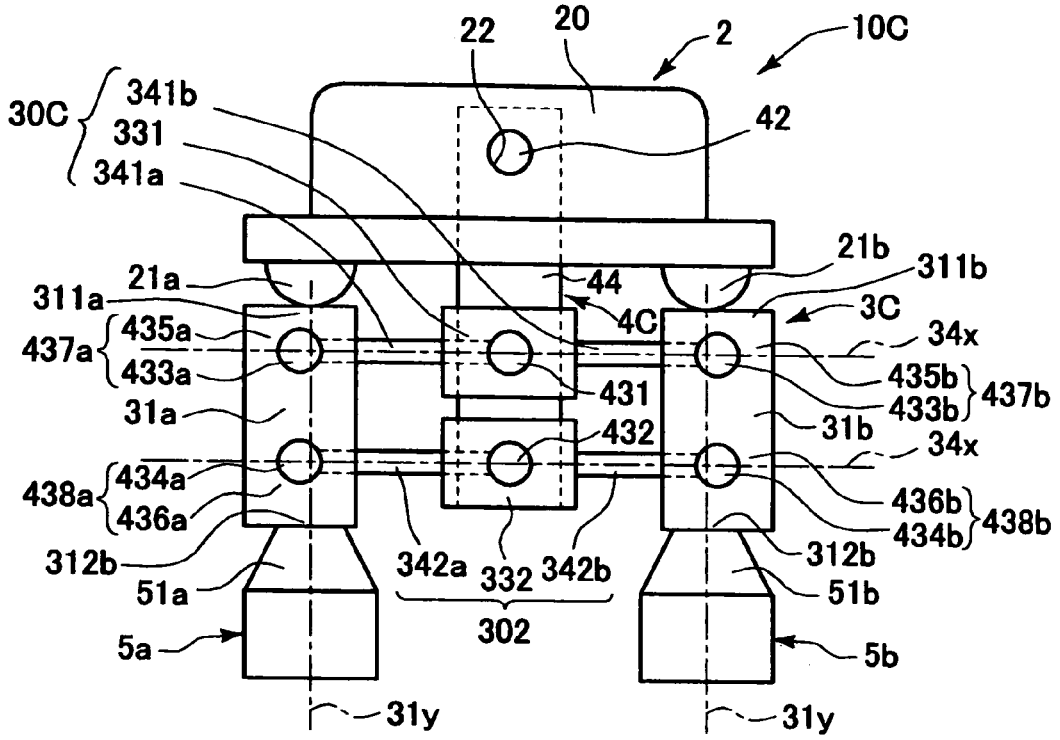
FIG. 11 is a schematic diagram showing a rocking switch unit according to a fourth embodiment of the invention.

As shown in FIG. 11, a rocking switch unit 10C according to a fourth embodiment includes a first middle rocking section 30C, a second middle rocking section 302, and the switch-pressing portions 31*a* and 31*b*. The first middle rocking section 30C and the second middle rocking section 302 are separated from each other to configurate a parallel link structure. Specifically, the first middle rocking section 30C includes a fulcrum coupling part 331, and rocking poles 341*a* and 341*b*. The second middle rocking section 302 includes a fulcrum coupling part 332, and rocking poles 342*a* and 342*b*. The rocking poles 341*a* and 342*a* are linked with the switch-pressing portion 31*a* through link fulcrum parts 433*a* and 434*a*, respectively. In addition the rocking poles 341*b* and 342*b* are linked with the switch-pressing portion 31*b* through link fulcrum parts 433*b* and 434*b*, respectively. The switch-pressing portion 31*a* has holding parts 435*a* and 436*a* for rotatably holding the link fulcrum parts 433*a* and 434*a*, respectively. The switch-pressing portion 31*b* has holding parts 435*b* and 436*b* for rotatably holding the link fulcrum parts 433*b* and 434*b*, respectively. The link fulcrum part 433*a* and the holding part 435*a* configurate a link section 437*a*, the link fulcrum part 434*a* and the holding part 436*a* configurate a link section 438*a*, the link fulcrum part 433*b* and the holding part 435*b* configurate a link section 437*b*, and the link fulcrum part 434*b* and the holding part 436*b* configurate a link section 438*b*. The link sections 437*a*, 438*a*, 437*b*, and 438*b* function as the angle-changing portions.

In the present case, a base section 4C is not required to have switch-pressing guide part 41*a* and 41*b*. Due to the parallel link structure, the switch-pressing portions 31*a* and 31*b* of the pressing joint 3 can move linearly to approach or separate from the corresponding tactile switches 5*a* and 5*b*, respectively, while keeping a state where the switch-pressing portions 31*a* and 31*b* protrude in the pressing direction of the switch knob 2. The fulcrum-forming portion 44 of the base-section 4C has the first rocking fulcrum 42 for the switch knob 2 and rocking fulcrums 431 and 432 for a pressing joint 3C. The first rocking fulcrum 42 and rocking fulcrums 431 and 432 are coaxially arranged in the pressing direction of the switch knob 2. The rocking fulcrums 431 and 432 are respectively inserted into the fulcrum coupling parts 331 and 332 to be rotatable.

Fifth Embodiment

Figure 12:
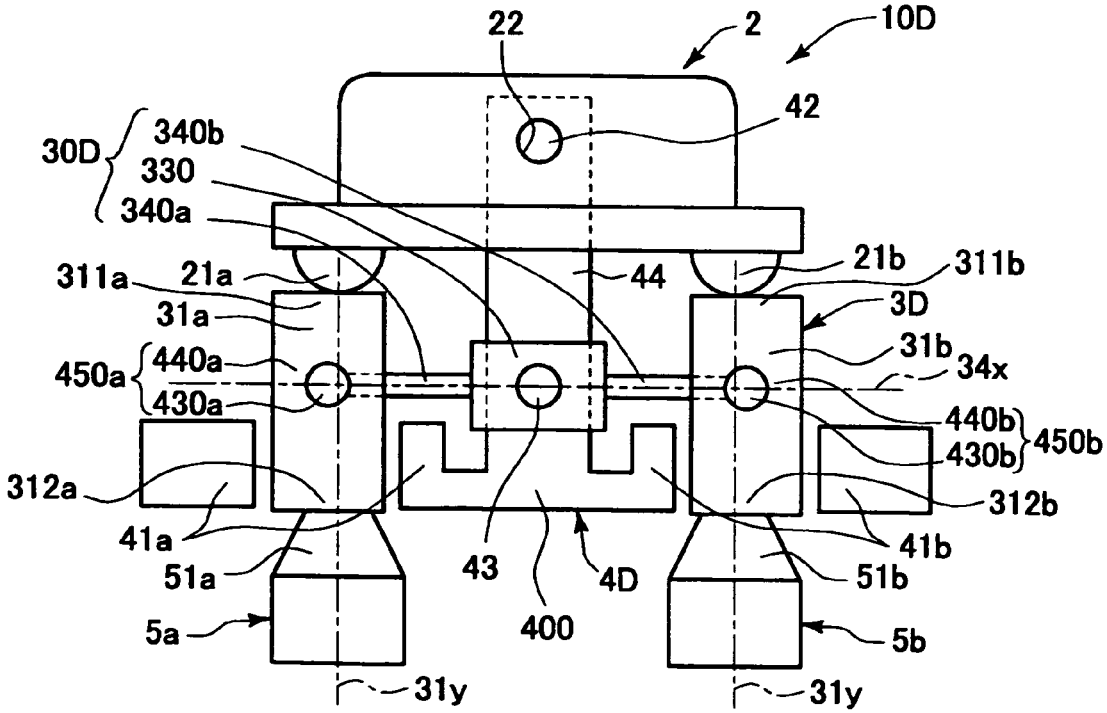
FIG. 12 is a schematic diagram showing a rocking switch unit according to a fifth embodiment of the invention.

A rocking switch unit 10D according to a fifth embodiment of the invention will be described with reference to FIG. 12. The rocking switch unit 10D includes the switch knob 2, a pressing joint 3D, and a base section 4D. The pressing joint 3D includes a single middle rocking section 30 that has a fulcrum coupling part 330 and rocking poles 340*a* and 340*b*. The rocking poles 340*a* and 340*b* are linked with the switch-pressing portions 31*a* and 31*b* through link fulcrum parts 430*a* and 430*b*. The switch-pressing portion 31*a* has a holding part 440*a* for rotatably holding the link fulcrum part 430*a*, and the switch-pressing portion 31*b* has a holding part 440*b* for rotatably holding the link fulcrum part 430*b*. The link fulcrum part 430*a* and the holding part 440*a* configurate a link section 450*a*, and the link fulcrum part 430*b* and the holding part 440*b* configurate a link section 450*b*. The fulcrum-forming portion 44 of the base section 4D has the first rocking fulcrum 42 and the second rocking fulcrum 43 that are coaxially arranged in the pressing direction of the switch knob 2. The second rocking fulcrum 43 is inserted into the fulcrum coupling part 330 to be rotatable. In a case where the pressing joint 3D has only single middle rocking section 30D, the base section 4D is required to have the switch-pressing guide parts 41*a* and 41*b*. In the present case, the link sections 450*a* and 450*b* function as the angle-changing portions.

Sixth Embodiment

Figure 13:
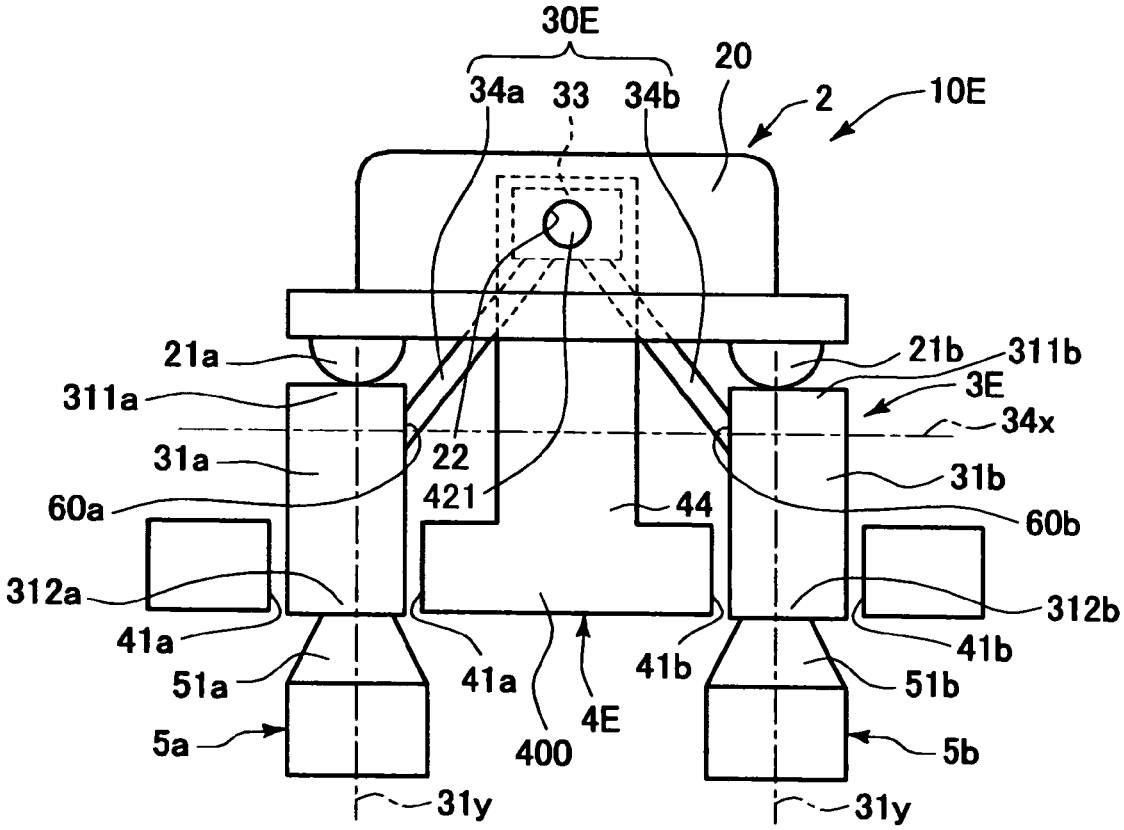
FIG. 13 is a schematic diagram showing a rocking switch unit according to a sixth embodiment of the invention.

A rocking switch unit 10E according to a sixth embodiment of the invention will be described with reference to FIG. 13. The rocking switch unit 10E includes the switch knob 2, a pressing joint 3E and a base section 4E. The fulcrum-forming portion 44 of the base section 4E has a single rocking fulcrum 421 to be inserted into both of the attachment hole 22 and the fulcrum coupling part 33. In the present case, the outer end parts 60*a* and 60*b* of the rocking poles 34*a* and 34*b* function as the angle-changing portion similarly with the rocking switch unit 10 according to the first embodiment.

Seventh Embodiment

Figure 18A:
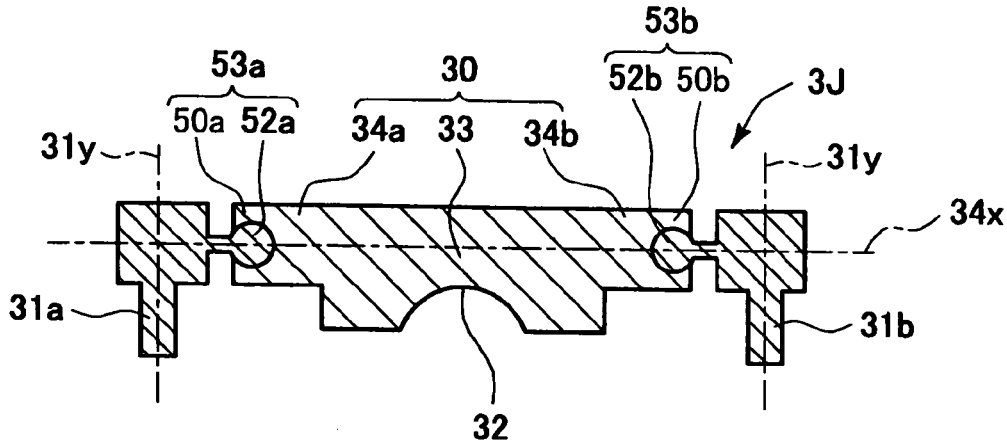
FIGS. 18A and 18B are cross-sectional views each showing a pressing joint according to a seventh embodiment of the invention.
Figure 18B:
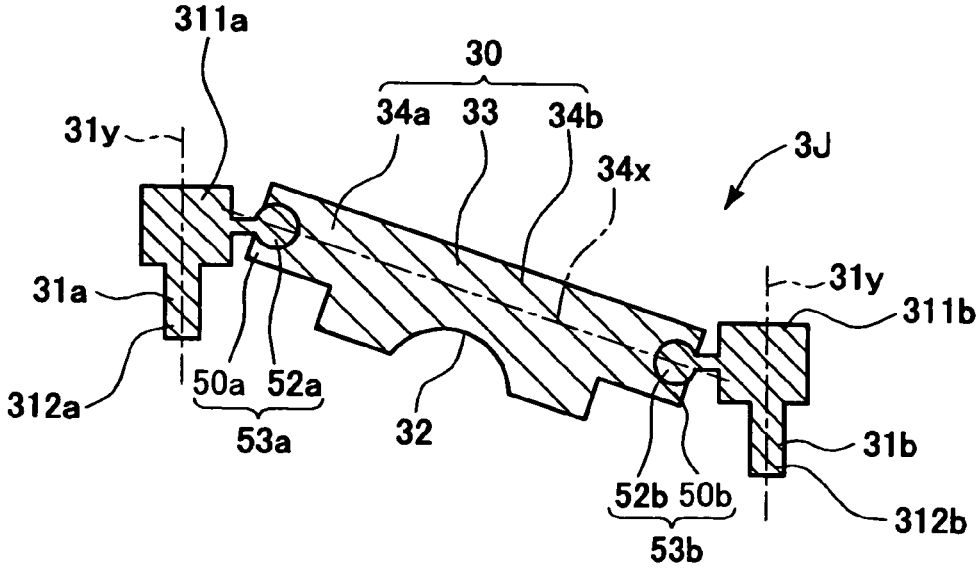

In a rocking switch unit according to a seventh embodiment of the invention, a pressing joint 3J shown in FIGS. 18A and 18B is used instead of the pressing joint 3 according to the first embodiment. The switch-pressing portions 31*a* and 31*b* are rotatably attached to end portions of the rocking poles 34*a* and 34*b* of the middle rocking section 30 through ball joint sections 53*a* and 53*b*. The ball joint section 53*a* includes a ball shaft 50*a* and a ball holding part 52*a*, and the ball joint section 53*b* includes a ball shaft 50*b* and a ball holding part 52*b*. Each of the ball shafts 50*a* and 50*b* has an approximately sphere shape at an end portion thereof. The ball holding parts 52*a* and 52*b* are provided for rotatably hold the ball shafts 50*a* and 50*b*, respectively, at least on the rocking surface. For example, the ball shafts 50*a* and 50*b* protruding from side surfaces of the switch-pressing portions 31*a* and 31*b* are fitted into the ball holding parts 52*a* and 52*b* provided at the end portions of the rocking poles 34*a* and 34*b*. Alternatively, the middle rocking section 30 may have the ball shafts 50*a* and 50*b* and the switch-pressing portions 31*a* and 31*b* have the ball holding parts 52*a* and 52*b*, respectively.

Eighth Embodiment

In the first to seventh embodiments, the pressing-force receiving parts 311*a* and 311*b* for receiving the pressing force from the rocking end portions 21*a* and 21*b* of the switch knob 2 are provided at a part of the switch-pressing portions 31*a* and 31*b* on the side of the switch knob 2 as an example. Alternatively, the pressing-force receiving parts 311*a* and 311*b* may be provided at the middle rocking section 30.

In the present case, the end portions of the middle rocking section 30 provide the pressing-force receiving parts 311*a* and 311*b*. The end portions of the middle rocking section 30 contact the rocking end portions 21*a* and 21*b* and are directly pressed by the rocking end portions 21*a* and 21*b* to receive the pressing force.

Figure 19A:
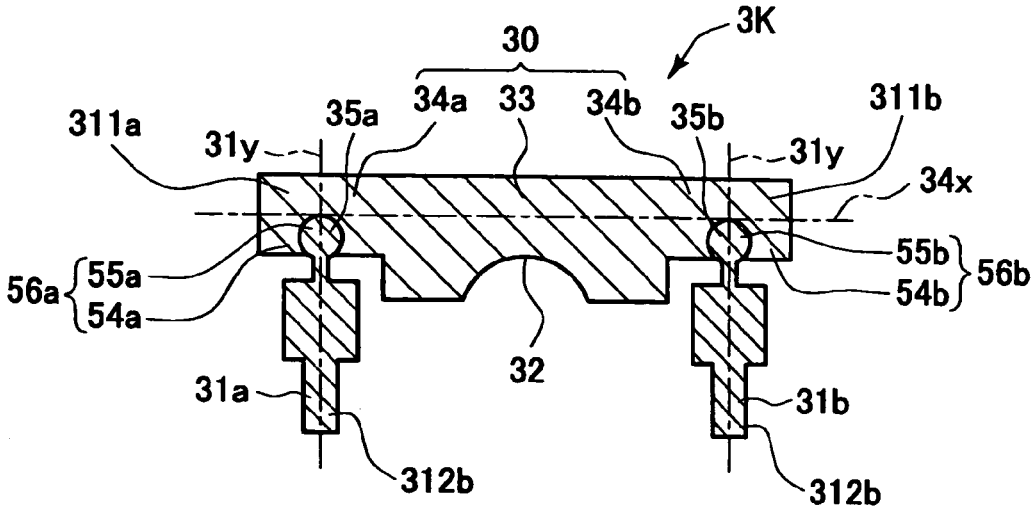
FIGS. 19A and 19B are cross-sectional views each showing a pressing joint according to an eighth embodiment of the invention.
Figure 19B:
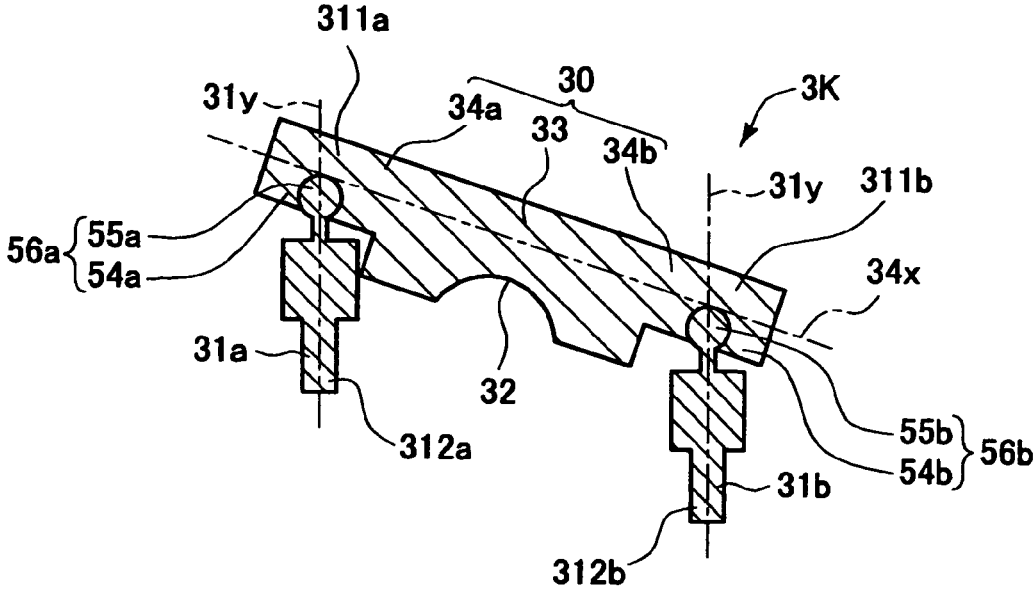

As shown in FIGS. 19A and 19B, in a pressing joint 3K according to an eighth embodiment of the invention, the pressing-force receiving parts 311*a* and 311*b* are provided at the end portions of the rocking poles 34*a* and 34*b* on the side of the switch knob 2. The switch-pressing portions 31*a* and 31*b* are attached at the end portions of the rocking poles 34*a* and 34*b* on a side of the tactile switches 5*a* and 5*b* through ball joint sections 56*a* and 56*b* that function as the angle-changing portion. The ball joint section 56*a* includes a ball shaft 55*a* and a ball holding part 54*a*, and the ball joint section 56*b* includes a ball shaft 55*b* and a ball holding part 54*b*. Each of the ball shafts 55*a* and 55*b* has an approximately sphere shape at an end portion thereof. The ball holding parts 54*a* and 54*b* are provided for rotatably holding the ball shafts 55*a* and 55*b*, respectively. In the pressing joint 3K shown in FIGS. 19A and 19B, the ball shafts 55*a* and 55*b* are provided at end portions of the switch-pressing portion 31*a* and 31*b*, respectively, and the ball holding parts 54*a* and 54*b* are provided at the end portions of the middle rocking section 30. Alternatively, the ball holding parts 54*a* and 54*b* may be provided at the end portions of the switch-pressing portion 31*a* and 31*b*, respectively, and the ball shafts 55*a* may be provided at the middle rocking section 30.

Ninth Embodiment

Figure 20A:
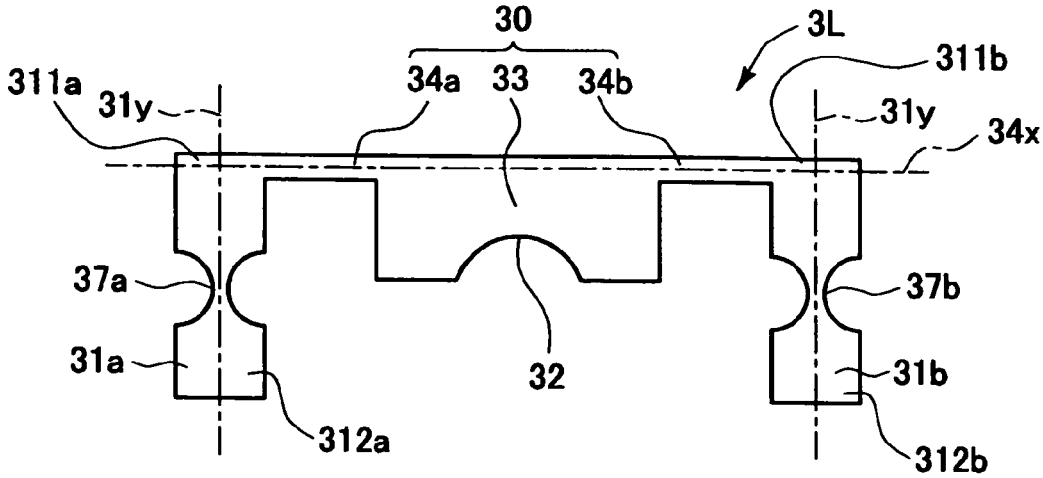
FIGS. 20A and 20B are front views each showing a pressing joint according to a ninth embodiment of the invention.
Figure 20B:
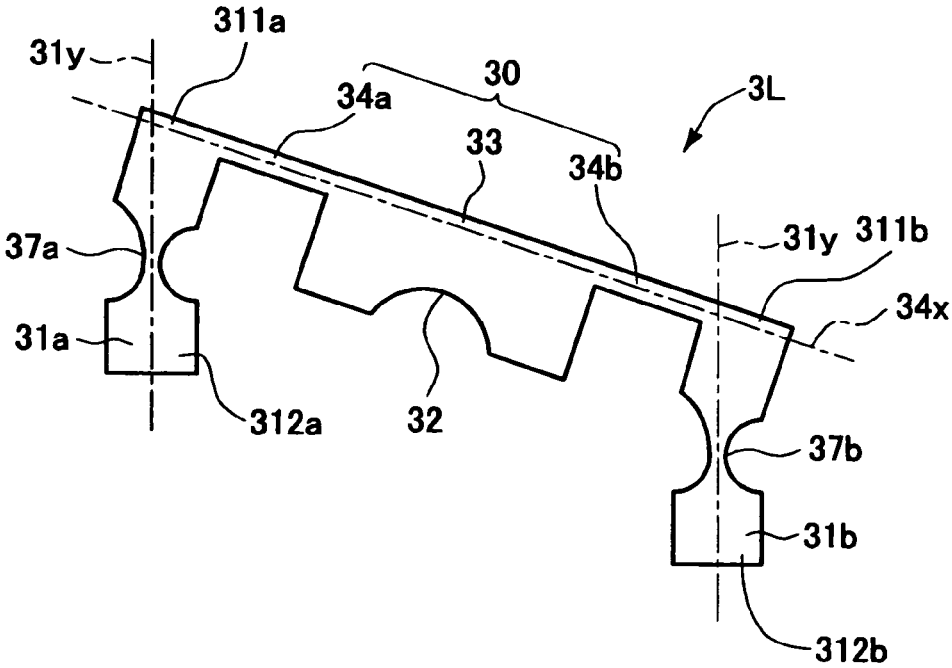

In a pressing joint 3L shown in FIGS. 20A and 20B, the pressing-force receiving parts 311*a* and 311*b* are provided at the end portions of the middle rocking section 30 on the side of the switch knob 2, similarly with the pressing joint 3K according to the eighth embodiment. In addition, the switch-pressing portions 31*a* and 31*b* are attached to the end portions of the middle rocking section 30 on the side of the tactile switches 5*a* and 5*b* through the angle-changing portions. Between the end portions of the middle rocking section 30 and the transmit parts 312*a* and 312*b* provided at the switch-pressing portions 31*a* and 31*b* on the side of the tactile switches 5*a* and 5*b*, elastic joint sections are provided so that the switch-pressing portions 31*a* and 31*b* can move toward the tactile switches 5*a* and 5*b* by changing the coupling angle $\theta_1$ between the middle rocking surface and the end rocking surface and the crossing angle between the extending axis 34*x* of the middle rocking section 30 and the protruding axis 31*y* of the switch-pressing portions 31*a* and 31*b*. For example, the middle rocking section 30 and the switch-pressing portions 31*a* and 31*b* are integrally formed with injection molding of resin and the end portions of the middle rocking section 30 protrude toward the tactile switches 5*a* and 5*b*. Between the end portions of the middle rocking section 30 and the transmit parts 312*a* and 312*b*, recess parts 37*a* and 37*b* are provided. The recess parts 37*a* and 37*b* are narrower than the outer end portions of the middle portion 30 and the other part of the switch-pressing portions 31*a* and 31*b* in the rocking radial direction. In the angle-changing portions shown in FIG. 20A and 20B, each side surfaces of the switch-pressing portions 31*a* and 31*b* that is located in the rocking radial direction is cut off from an outside to provided a curved recess parts 37*a* and 37*b*. Thereby, the middle rocking section 30 and the switch-pressing portions 31*a* and 31*b* can rotate relative to each other in the rocking surface.

Tenth Embodiment

Figure 21A:
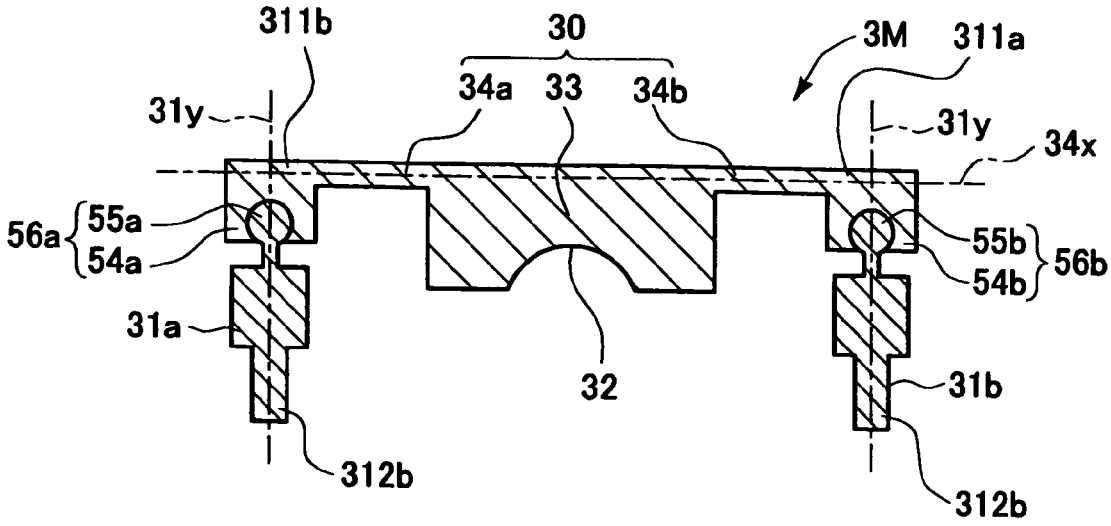
FIGS. 21A and 21B are cross-sectional views each showing a pressing joint according to a tenth embodiment of the invention.
Figure 21B:
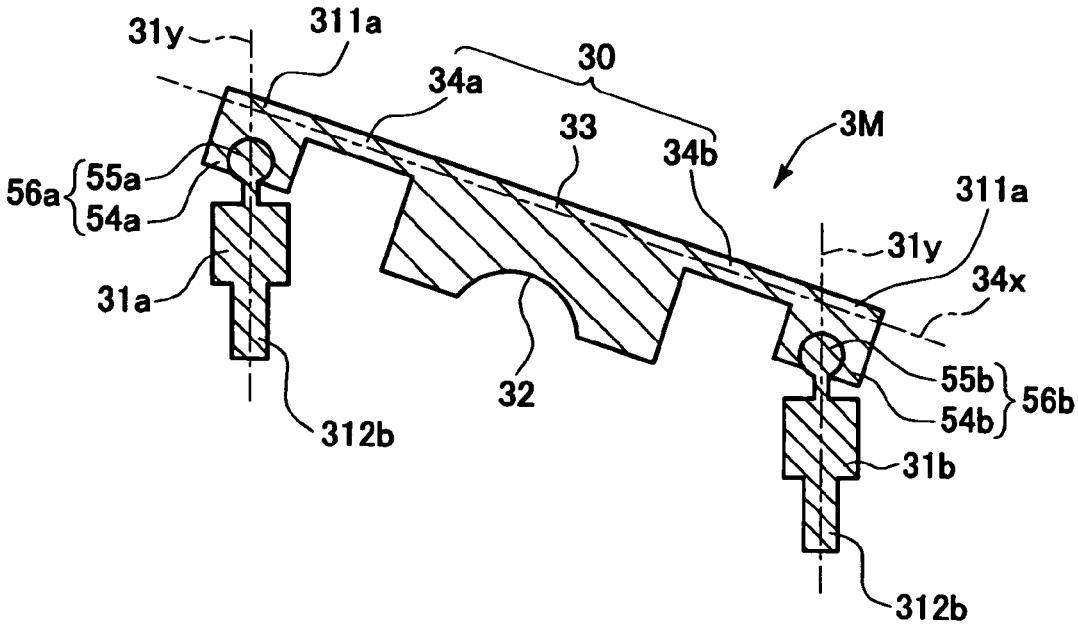
Figure 22:
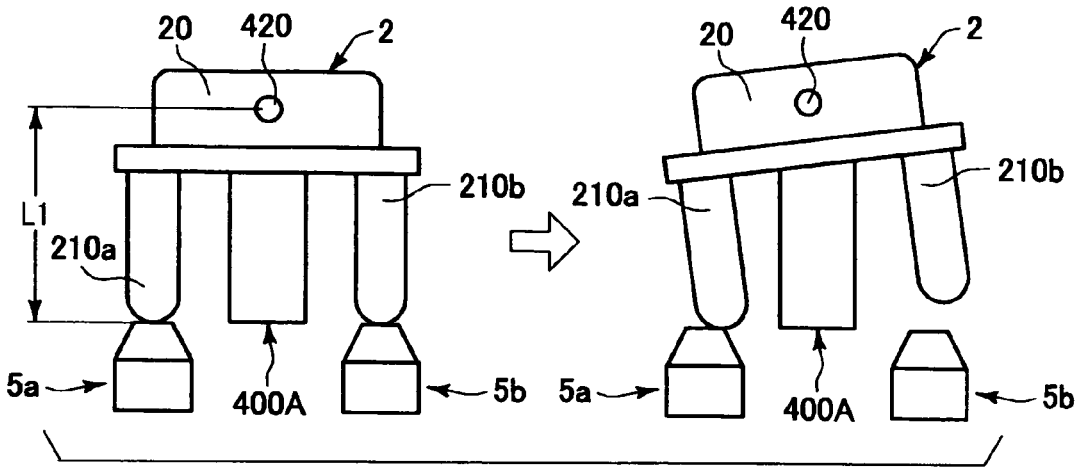
FIG. 22 RELATED ART
FIG. 22 is a schematic diagram showing a rocking switch unit according to a first example of the related art.
Figure 23:
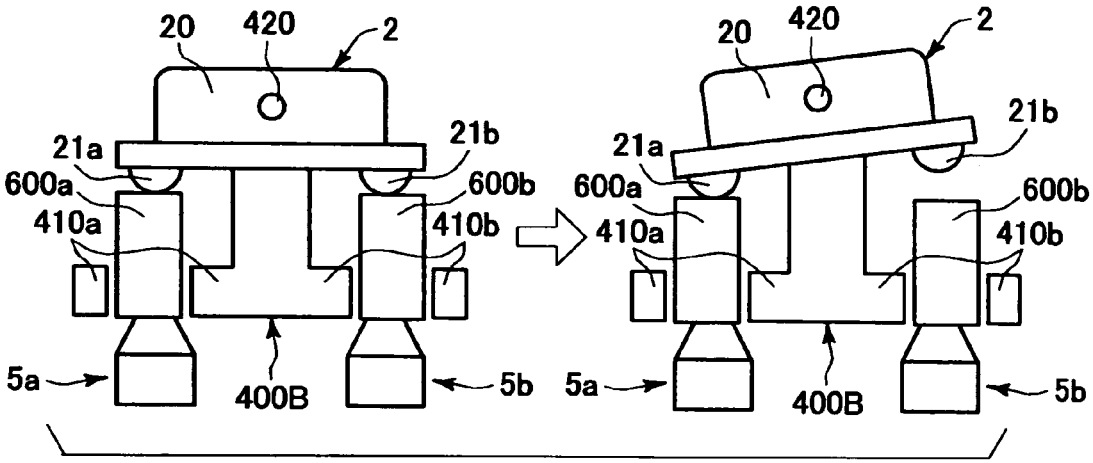
FIG. 23 RELATED ART
FIG. 23 is a schematic diagram showing a rocking switch unit according to a second example of the related art.
Figure 24:
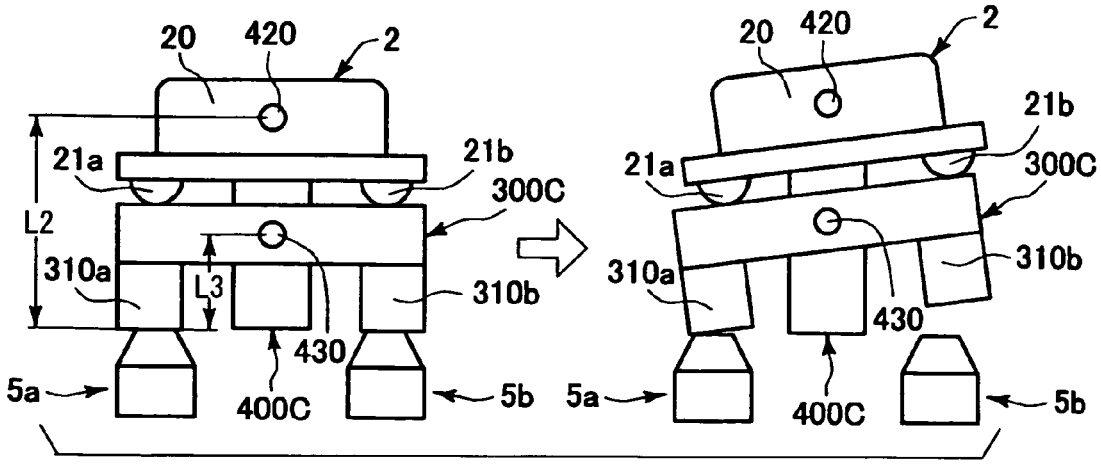
FIG. 24 PRIOR ART
FIG. 24 is a schematic diagram showing a rocking switch unit according to the prior art.

In a pressing joint 3M according to a tenth embodiment of the invention, the end portions of the middle rocking section 30 protrude toward the tactile switches 5*a* and 5*b* similarly to the pressing joint 3L, as shown in FIGS. 21A and 21B. In the present embodiment, the ball joint sections 56*a* and 56*b* function as the angle-changing portions similarly to the eighth embodiment.

Each component in the above-described embodiments can be combined each other. Alternatively, the rocking end portions 21*a* and 21*b* may have the angle-changing portions. Such changes and modifications are to be understood as being within the scope of the present invention as defined by the appended claims.

What is claimed is:

1. A rocking switch unit comprising:

a base section that has a first rocking fulcrum and a second rocking fulcrum;

a switch knob that is coupled with the base section through the first rocking fulcrum to be rockable in two ways and that has a pair of rocking end portions located on two sides with respect to the first rocking fulcrum;

a pair of tactile switches disposed to correspond to the pair of rocking end portions;

a middle rocking section that is coupled with the based section through the second rocking fulcrum to be rockable in the two ways in conjunction with the switch knob and that has a rocking pole extending toward two sides with respect to the second fulcrum and having a pole rocking surface crossing a pressing direction;

a pair of switch-pressing portions that is located between the pair of rocking end portions and the pair of tactile switches for transmitting a pressing force from one of the rocking end portions to the corresponding tactile switch when the one of the rocking end portions is pressed in the pressing direction and that has an end rocking surface crossing the pressing direction and that is coupled with two end portions of the rocking pole in such a manner that a coupling angle between the pole rocking surface and end rocking surface is variable in the pressing direction; and a pair of guide parts disposed between the pair of switch-pressing portions and the pair of tactile switches and each having a guide hole for guiding the switch-pressing portions to be linearly movable between a releasing position at which the switch knob is in a neutral position and a pressing position at which one of the switch-pressing portions press the corresponding tactile switch; wherein the coupling angle between the pole rocking surface and the end rocking surface increases when the one of the switch-pressing portions approaches the corresponding tactile switch, the base section includes a fulcrum-forming portion at which the first rocking fulcrum and the second rocking fulcrum are disposed and a base portion that extends from the fulcrum-forming portion approximately perpendicularly to the pressing direction and that is arranged between the middle rocking section and the tactile switches, the pair of guide parts are located at the base portion, each of the guide holes extend in the pressing direction, the switch-pressing portions are inserted into the guide holes, respectively, to be movable in the pressing direction, the fulcrum-forming portion extends in the pressing direction toward an opposite side of the tactile switches with respect to the base portion, a first distance between the first rocking fulcrum and the base portion is longer than a second distance between the second rocking fulcrum and the base portion, and the middle rocking section has an approximately horizontal elastic beam shape in a state where the middle rocking section does not rock.

2. The rocking switch unit according to claim 1, wherein:

the pair of switch-pressing portions is integrated with the end portions of the rocking pole; and the rocking pole is configured to be elastically deformable for varying the coupling angle when one of the switch-pressing portions is pressed toward the corresponding tactile switch.

3. The rocking switch unit according to claim 2, wherein the middle rocking section and the pair of switch-pressing portions are made of an injection-molded resin.

4. The rocking switch unit according to claim 2, wherein:

the rocking pole has a first dimension in a direction approximately parallel to the pole rocking surface and a second dimension in the pressing direction; and the first dimension is larger than the second dimension.

5. The rocking switch unit according to claim 4, wherein the rocking pole is made of a single plate.

6. The rocking switch unit according to claim 2, wherein the rocking pole includes a plurality of pole elements that extends in a direction approximately parallel to the pole rocking surface and that is separated from each other in the pressing direction;

each of the pole elements has a first dimension in the extending direction and a second, dimension in the pressing direction; and the first dimension is larger than the sum of the second dimensions of the plurality of pole elements.

7. The rocking switch unit according to claim 1, wherein:

one of the middle rocking section and the pair of switch-pressing portions has two shafts protruding toward the other one; and the other one of the middle rocking section and the pair of switch-pressing portions has two holding parts for rotatably holding the shafts.

8. The rocking switch unit according to claim 7, wherein:

the shafts are disposed at one of the end portions of the rocking pole and end portions of the pair of switch-pressing portions; and the holding parts are provided at the other one of the end portions of the rocking pole and end portions of the pair of switch-pressing portions.

9. The rocking switch unit according to claim 1, wherein the end portions of the rocking pole contact the pair of the rocking end portions for transmitting the pressing force from the pair of the rocking end portions to the pair of the switch-pressing portions.

10. The rocking switch unit according to claim 1, wherein the pair of the switch-pressing portions contact the pair of the rocking end portions.

11. The rocking switch unit according to claim 1, wherein each of the switch-pressing portions is coupled with the end portion of the rocking pole through a coupling part; and the coupling parts are elastically deformable when one of the rocking end portions is pressed in the pressing direction.

12. The rocking switch unit according to claim 1, wherein the first rocking fulcrum and the second rocking fulcrum are integrated with each other.

13. The rocking switch unit according to claim 1, wherein:

the middle rocking section has a first axis that connects the end portions of the rocking pole;

each of the switch-pressing portions protrudes along a second axis toward the corresponding tactile switch; and each of the switch-pressing portions is movable in the pressing direction toward the corresponding tactile switch by changing a crossing angle between the first axis and the second axis.

14. The rocking switch unit according to claim 1, wherein:

the rocking pole extends in an approximately horizontal direction from the second rocking fulcrum;

the rocking pole has a first dimension in the extending direction and a second dimension in the pressing direction; and the first dimension is larger than the second dimension.

15. The rocking switch unit according to claim 1, wherein:

the second rocking fulcrum has a cylindrical curved surface and has an axis approximately perpendicular to a longitudinal direction of the switch knob and the pressing direction; and a bottom surface of the middle rocking section is disposed on the cylindrical curved surface of the second rocking fulcrum.

* * * * *